US005372181A

United States Patent [19]

Watanabe et al.

[11] Patent Number: 5,372,181

[45] Date of Patent: Dec. 13, 1994

[54] COUNTER PRESSURE CASTING AND COUNTER PRESSURE CASTING DEVICE

[75] Inventors: Fukashi Watanabe; Shigeo Hama, both of Kumagaya; Norio Minami, Mooka, all of Japan

[73] Assignee: Hitachi Metals, Ltd., Tokyo, Japan

[21] Appl. No.: 13,089

[22] Filed: Feb. 3, 1993

[30] Foreign Application Priority Data

| | | | |
|---|---|---|---|
| Mar. 26, 1992 | [JP] | Japan | 4-098530 |
| Mar. 26, 1992 | [JP] | Japan | 4-098531 |
| Mar. 26, 1992 | [JP] | Japan | 4-098532 |
| Oct. 14, 1992 | [JP] | Japan | 4-301874 |
| Oct. 14, 1992 | [JP] | Japan | 4-301875 |
| Jan. 14, 1993 | [JP] | Japan | 5-022088 |

[51] Int. Cl.[5] ..... J22D 18/04

[52] U.S. Cl. ..... 164/457; 164/4.1; 164/119; 164/113; 164/120

[58] Field of Search ..... 164/4.1, 457, 47, 62, 164/68.1, 113, 119, 133, 155, 256, 257, 285, 284, 306, 308, 309, 337, 120

[56] References Cited

U.S. PATENT DOCUMENTS

| | | | |
|---|---|---|---|
| 3,532,154 | 10/1970 | Balevski | 164/119 |
| 3,961,662 | 6/1976 | Balevski | 164/457 |
| 4,671,342 | 6/1987 | Balevski | 164/119 |
| 4,889,177 | 12/1989 | Charbonnier | 164/306 |

FOREIGN PATENT DOCUMENTS

| | | | |
|---|---|---|---|
| 252397 | 6/1964 | Australia | 164/306 |
| 2250996 | 5/1974 | Germany . | |
| 3927998 | 3/1990 | Germany . | |
| 54-29448 | 9/1979 | Japan | 164/306 |
| 59-54458 | 3/1984 | Japan | 164/308 |
| 63-273561 | 11/1988 | Japan . | |
| 1186259 | 7/1989 | Japan . | |
| 1278949 | 11/1989 | Japan . | |
| 2187247 | 7/1990 | Japan . | |
| 2204816 | 11/1988 | United Kingdom . | |
| 482243 | 2/1976 | U.S.S.R. | 164/306 |

*Primary Examiner*—P. Austin Bradley
*Assistant Examiner*—Erik R. Puknys
*Attorney, Agent, or Firm*—Sughrue, Mion, Zinn, Macpeak & Seas

[57] ABSTRACT

A counter pressure casting and a counter pressure casting device in which the pressures in a furnace side and a casting mold side are set to be lower than the maximum pressure of the process at a stage of the molten metal charging and increased to the maximum after the molten metal charging step. This technique provides a casting having less casting defects and improves the productivity.

15 Claims, 19 Drawing Sheets

COUNTER PRESSURE CASTING AND COUNTER PRESSURE CASTING DEVICE

FIELD OF THE INVENTION

This invention relates to a method for casting metal such as aluminum alloy, magnesium alloy, titanium alloy or the like, and particularly to a counter pressure casting and its device, wherein a molten metal-containing furnace and a casting mold are placed in airtight pressure containers, a gas having a pressure higher than the atmospheric pressure is charged into the containers, the pressure on the furnace side is relatively increased more than the casting mold side, thereby charging the molten metal, into the casting mold.

BACKGROUND OF THE INVENTION

Casting defects such as pinholes, shrinkage cavity (porosity) or the like due to solidification and shrinkage of the molten metal in the process of casting metals such as aluminum alloy, magnesium alloy, titanium alloy or the like air bubbles or hydrogen gas bubbles in dendrite trees are generated in the solidification process and grow with the solidification progress of the molten metal.

The hydrogen gas bubbles which form a nucleus of casting defects are generated when ambient pressure in a pressure container acting on the molten metal is lower than the hydrogen gas partial pressure in the molten metal, and the hydrogen gas partial pressure is sharply increased as the liquid phase ratio lowers.

To prevent the hydrogen gas bubbles from forming, it is effective to apply ambient pressure higher than the hydrogen gas partial pressure onto the molten metal at the stage prior to the solidification of the molten metal. A casting method disposing a casting mold and a furnace in airtight pressure containers and applying higher pressure than the atmospheric pressure to the pressure containers was invented in Bulgaria in the 1960s, which is widely known as Counter Pressure Casting.

In this counter pressure casting, as shown in FIG. 18 describing pressure control pattern, the holding furnace and the casting mold in the pressure containers are applied the same pressure from the atmospheric pressure to the set pressure P1, then, the pressure in the casting mold side is lowered while keeping that in the holding furnace side at the set level by which the molten metal starts to be charged into the casting mold. Then, after the charging of the molten metal is completed at T2, the pressures in both sides are maintained at certain levels from T2 to T3. After T3, the casting mold side pressure is increased to the holding furnace side pressure to dissolve the differential pressure. thereby the molten metal is returned to the holding furnace at T4. Further, after T4, the process discharging the gas from the pressure containers to the atmosphere starts to complete the casting of one cycle at T5.

As to the above Counter Pressure Casting, Japanese Patent Laid-open No. 186259/1989 and Japanese Patent Laid-open No. 278949/1989 disclosed casting methods characterized by providing the differential pressure between the casting mold side and the holding furnace side at from 0.5 to 30% of the maximum pressure; a method applying and holding the pressure of from 3 to 7 kgf/cm$^2$ to the pressure containers, then adjusting the differential pressure at from 3 to 30% of the holding pressure; and a method increasing and holding the pressure of the containers at from 7 to 30 kgf/cm$^2$, then adjusting the differential pressure at from 0.5 to 10% of the holding pressure. Further, Japanese Patent Laid-open No. 187247/1990 disclosed a casting method characterized by a following pressure controlling: applying a given pressure to both containers, retention thereof, generation of the differential pressure between both containers and its retention, and decrease of pressure to the atmospheric pressure.

But, the above conventional counter pressure casting has the following problems.

As shown in FIG. 18, the pressures of the furnace side and casting mold side have to be previously increased go P1 which is the maximum pressure in the process before T1 when the molten metal starts to be charged into the casting mold. This makes the duration till T1 long resulting in its low productivity in industrial application.

In order to decrease the period till T1 to improve the productivity, an air current has to be blown into the both containers at a high speed, by which the molten metal within the furnace side container is stirred causing the generation of oxides of the molten metal. Such oxides are mixed with the casting as non-metal inclusions providing the deterioration of the casting. Such non-metal inclusions cause internal or external defects and poor strength in the casting.

Further, the conventional counter pressure casting mentioned above is a method to charge the molten metal into the casting mold by either of the casting mold side pressure reduction method or the furnace side pressure increase method, and the differential pressure is to increase while forming a simple primary curve, Since the differential pressure increasing speed is kept statically even after the completion of charging of the molten metal, unequal solidification proceeds, and feeding head effect from the holding furnace side cannot be expected. As a result, casting defects are left behind to cause internal or external defects and poor strength in the product.

Such defects become particularly obvious when a thin-wall part with a complicated shape, thick-wall part or a material that is difficult to cast is cast, and can not be removed completely.

In addition, in the conventional counter pressure casting shown in FIG. 18, the compressed pressure in both containers is entirely discharged into the atmosphere through an exhaust pipe after solidifying so that the molten metal is returned to the holding furnace. Therefore. The molten metal moves up and down between x in FIG. 19 showing a conventional counter pressure casting device for every casting cycle, wherein x represents the distance between the molten metal surface in the furnace and the molten metal highest position in the casting mold. As the above casting work progresses, the surface of the molten metal in the furnace gradually lowers resulting in appearance of y in FIG. 19 representing the difference between the initial and final height of the molten metal in the furnace. This causes the molten metal temperature, and the necessary charging pressure and time to be changed, and accordingly, affects the quality of the casting as dispersing.

Furthermore, as a result of the molten metal moving up and down within molten metal feeding pipe, turbulent flow is induced in the molten metal in the furnace causing gas entrainment and other defects.

SUMMARY OF THE INVENTION

An object of this invention is to provide a counter pressure casting and counter pressure casting device which can improve productivity by shortening the casting cycle time when applied to industrial production.

Another object of this invention is to provide a counter pressure casting and counter pressure casting device capable of stabilizing the casting conditions so as to obtain casting with little casting defects or little non-metallic inclusion when a thick-wall casting or thin-wall casting with a complicated shape is produced or when a material that is difficult to cast is used.

It has now been found that the objects of the present invention can be attained when the pressures in both containers are held lower than the maximum pressure at the stage before the start of charging of the molten metal into the casting mold, and when they are increased to the maximum in the process of applying and holding the pressure to make the differential pressure after charging of the molten metal.

Further, the objects of the present invention can be achieved when a pressure slightly higher than the atmospheric pressure is always applied to the furnace side container to position the molten metal surface slightly lower than the sprue of the casting mold in the molten metal feeding pipe.

DETAILED DESCRIPTION OF THE INVENTION

Figure 1:
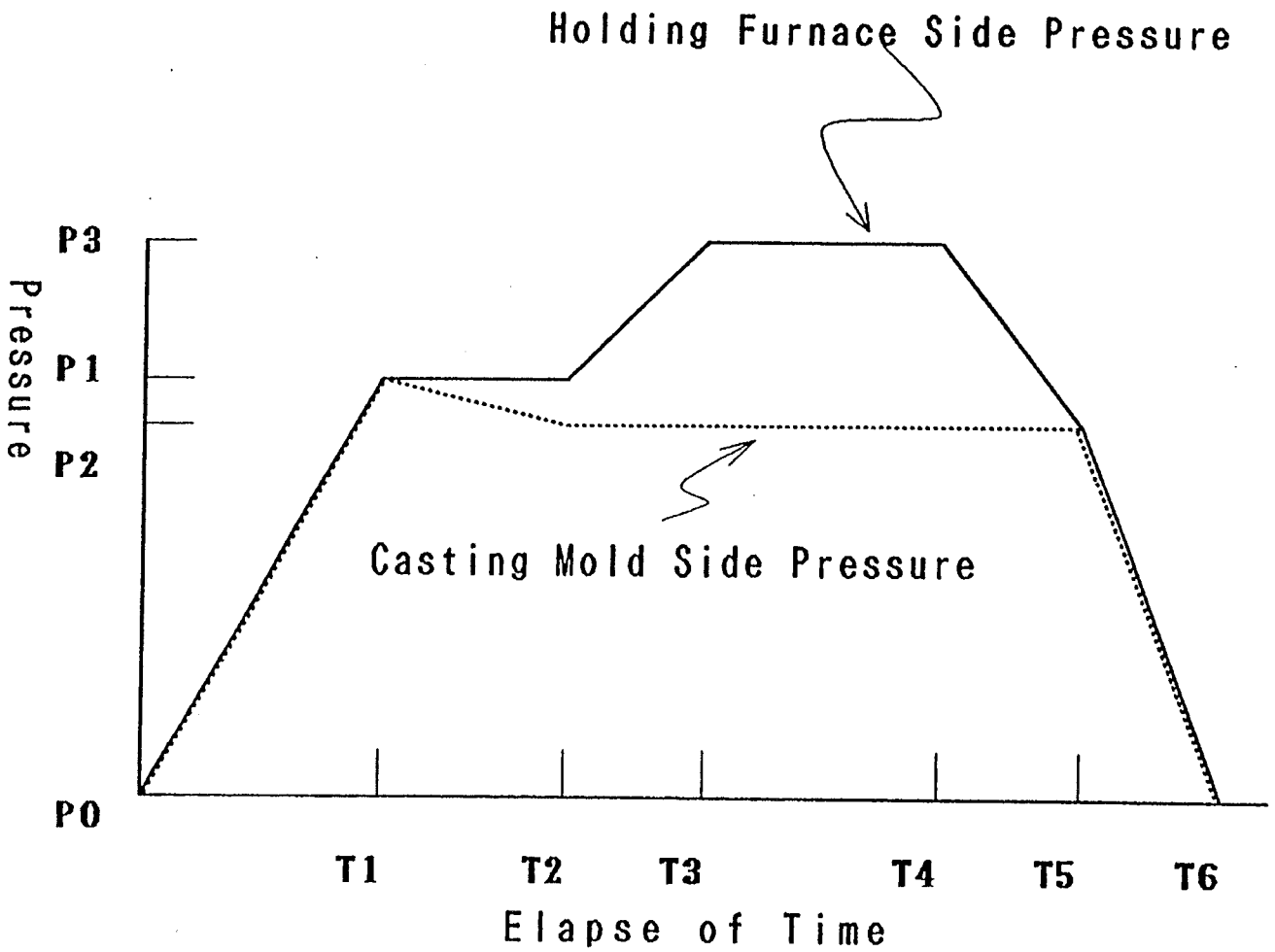
FIG. 1 is a graph showing one example of the pressure control pattern with respect to the holding furnace side container and the casting mold side container according the present invention.

The counter pressure casting according to this invention communicates the casting mold side pressure container having a casting mold disposed inside and the holding furnace side pressure container having a furnace containing molten metal disposed inside by means of a molten metal feeding pipe, and is characterized by:

(1) "molten metal charging step" to charge the molten metal into the casting mold under a pressure lower than the maximum pressure in the containers, (2) "container interior pressure increasing step" to increase the pressures in the holding furnace side container and the casting mold side container, (3) "differential pressure holding step" to hold the differential pressure between both containers of the holding furnace side and the casting mold side at a certain pressure, (4) "differential pressure dissolving step" to dissolve differential pressure between the both pressure containers, and (5) "pressure reducing step" to reduce the pressures in both containers to certain ambient pressures.

In the above counter pressure casting, it is preferable that a pressure slightly higher than the atmospheric pressure is always applied to the holding furnace side container, thereby positioning the molten metal surface slightly lower than the sprue of the casting mold in the molten metal feeding pipe.

In this case, the pressure always applied to the holding furnace side container is desirably changed as required based on (1) properties of the molten metal, (2) characteristics of the device and others, and (3) the distance between the molten metal surface in the molten metal feeding pipe 5 and the remaining molten metal surface in the holding furnace. A pressure mentioned above is determined, and successively increased with the progress of the casting work so as to maintain the surface of the molten metal in the molten metal feeding pipe 5 to be at a certain level.

The maximum pressure in the containers is set by various conditions such as the composition of molten metal, the usage of the product, the shape of the product and the like, and defined as the maximum value of the absolute pressure in the holding furnace side container and/or casting mold side container based on the atmospheric pressure in the casting process of one cycle.

The container interior pressure at the start of charging the molten metal into the casting mold is preferably set to 0 to 50% of the above maximum pressure, and more preferably to 10 to 30% of the maximum pressure. When it exceeds 50% of the maximum pressure, it is necessary to increase the rate of air current blown into the container to reduce the casting cycle time, and as a result, some characteristics of the product are deteriorated by stirring and oxidation of the molten metal caused by the air current. If it is less than 10% of the maximum pressure, casting defects in the product can not be removed completely. On the other hand, when it exceeds 30% of the maximum pressure, inclusions may be mixed into the casting, possibly lowering the strength of the product.

According to the present invention, generation and increase of the differential pressure in the molten metal charging step include the following embodiments and they are suitably combined for practice depending on the use, the material and the shape of the desired casting.

(1) Holding furnace side pressure increase with casting mold side constant pressure
(2) Holding furnace side pressure increase with casting mold side pressure increase
(3) Holding furnace side pressure increase with casting mold side pressure decrease
(4) Holding furnace side constant pressure with casting mold side pressure decrease
(5) Holding furnace side pressure decrease with casting mold side pressure decrease In the above embodiments, when the molten metal charging step is a composite step including a step increase a pressure in the holding furnace side container and a step to increase a pressure in the casting mold side container, differential pressures between the both containers is generated relatively by the difference of the pressure increase between both containers, thereby the texture of the product can be made fine as the absolute pressure can be set higher and casting defect occurrence can be prevented as the differential pressure increasing speed is varied in high velocity.

When the molten metal charging step is determined to be a step to lower the pressure in the casting mold side container, the molten metal is fed into the casting mold by the suction force and a run into the casting mold can be improved.

Further, in any of the above embodiments, the molten metal charging step can be designed to consist of the first step molten metal charging process and the second step molten metal charging process which has a greater differential pressure increase than the first step process. Thus, a desirable product having no defects can be produced because applying a high differential pressure which is required according to the progress of solidification of the molten metal and the feeding head effect caused by the impact on the differential pressure change point from the first step process to the second step process. In addition, generation of solidification nucleus is accelerated, thereby much finer texture can be obtained.

The differential pressure change point from the above first step process to the second step process can be set at the completion of charging the molten metal into the casting mold. Thus, the differential pressures required respectively in the process of the molten metal feeding process into the casting mold and the solidification process after the completion of molten metal charging can be efficiently and effectively applied. In order to know when the molten metal charging is complete, a plurality of thermo couples disposed on the casting mold cavity surface can be used by detecting a temperature change.

In the above case, the embodiment of generation and increase of the differential pressure on the first step molten metal charging process and the second step molten metal charging process has the following variations and they are suitably combined for practice depending on the use, the material and the shape of the desired casting.

(1) Holding furnace side pressure increase with casting mold side constant pressure
(2) Holding furnace side pressure increase with casting mold side pressure increase
(3) Holding furnace side pressure increase with casting mold side pressure decrease
(4) Holding furnace side constant pressure with casting mold side pressure decrease
(5) Holding furnace side pressure decrease with casting mold side pressure decrease The differential pressure between the holding furnace side container and the casting mold side container in the above steps are designed to form a non-linear curve in a pressure-time curve which shows non-proportional relation with the passage of time, thereby desirable pressure control can be achieved to prevent the molten metal in the furnace of unnecessary air blowing caused by the increase of pressure, and the casting cycle time can be shortened. As a result, the product with preferable properties depending on the kind, the use and the shape can be obtained.

Aforementioned "differential pressure holding step" can be varied as a process to increase the pressures in both containers of the holding furnace side and casting mold side having constant differential pressure. Further, it can be made to consist of the first step differential pressure holding process to increase the pressures in both containers of the holding furnace side and casting mold side having constant differential pressure, and the second step differential pressure holding process to hold constant pressures in both containers respectively. Thus, by continuing the pressure increase of both containers even in the differential pressure holding step, the characteristics of the product are improved, especially the toughness is increased as the crystalline particles of the product are made fine.

According to the counter pressure casting of this invention, quite good characteristics can be obtained for the thin wall portion of a casting. But, the thick wall portion or a thin-wall portion with a complicated shape may suffer from the concentration of casting defects.

As a result of further study, it has now been found that concentration of casting defects mentioned above is caused due to an application of a high pressure to the holding furnace side container and the casting mold side container in an early stage of casting. Based on such study, a measure to prevent the concentration of casting defects on a thick-wall portion or a thin-wall portion with complicated shape was taken as follows.

According to the counter pressure casting of this invention, it is preferable to hold the pressure in the casting mold side container to be low for a prescribed time after the completion of charging of the molten metal.

The above low pressure is defined as a pressure 0 to 3 kg/cm$^2$ higher than the atmospheric pressure, and its low pressure holding time can be set as a time when the solidification of a desired part of the casting completes. Thereby, the concentration of casting defects on a certain part can be prevented, and the strength of the product can be improved efficiently.

According to the counter pressure casting of this invention, it is also desirable to hold the pressure in the holding furnace side container and the casting mold side container to a certain pressure for a certain time after the completion of charging of the molten metal.

The certain pressure holding time mentioned above can be set as a time when solidification at a desired part of the casting is complete.

The certain part mentioned above can be set as a portion required to have strength particularly when the subject casting is actually used, or a portion which is recognized by experience to have the generation of faults due to the concentration of casting defects.

Accordingly, by the counter pressure casting of this invention, a casting without localized concentration of casting defects can be obtained even when a particularly thick wall casting or the thin-wall casting with a complicated shape is produced.

The counter pressure casting device of this invention comprises a casting mold side pressure container having a casting mold disposed inside, a holding furnace side pressure container having a furnace containing molten metal inside, a molten metal feeding pipe for connecting the furnace interior and the casting mold interior, a pressure means to respectively increase the pressure in the holding furnace side container and the casting mold side container to exceed the atmospheric pressure, and pressure control means having a function to control the pressures in the casting mold side container and the holding furnace side container to be lower than the maximum pressure in the containers at the time of starting the molten metal charging process.

The above counter pressure casting device further includes a means to detect charging of the molten metal into the casting mold. The above pressure control means has a function to vary a differential pressure increasing speed between the casting mold side container and the holding furnace side container in combination with the charging detection means.

In addition, the above pressure control means has a function to always apply slightly higher pressure than the atmospheric pressure to the holding furnace side container.

The above pressure control means is preferably set so that the pressures in the casting mold side container and the holding furnace side container are controlled to 0 to 50% of the maximum pressure when the molten metal charging process is started.

Additionally, the above pressure control means can be set as the casting mold side container has a pressure substantially the same as the atmospheric pressure while the pressure in the holding furnace side container is increased when charging of the molten metal into the casting mold starts, then both containers are kept at certain pressures for a certain period. This prevents casting defects from concentrating into the thick portion of the product.

Further, concentration of casting defects into the thick portion of the product can be also prevented by setting the above pressure control means to hold the casting mold side container to a low pressure for a certain period before simultaneously increasing the pressures of both containers after charging the molten metal into the casting mold.

The aforementioned counter pressure casting and counter pressure casting device of this invention will be specifically described with reference to the drawings.

Figure 2:
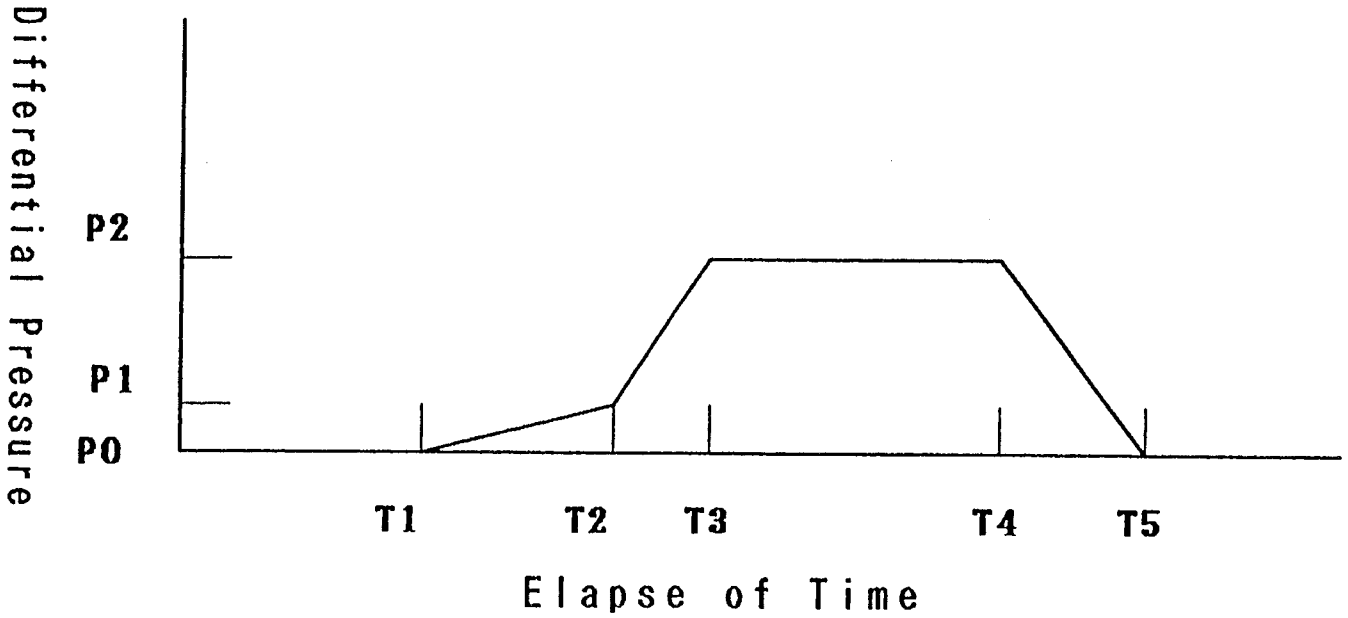
FIG. 2 is a graph showing a differential pressure pattern generated due to the pressure control pattern shown in FIG. 1.

FIG. 1 shows one example of the pressure control pattern in the casting mold side container and the holding furnace side container by this invention, and FIG. 2 shows a differential pressure pattern between both containers generated by the pressure control pattern of FIG 1. In FIG. 1, FIG. 3 through FIG. 12 and FIG. 18, the solid line shows the pressure pattern in the furnace side container and the dotted line shows that in the casting mold side container. Both containers have their pressures increased to P1 from the start of casting to T1, and the casting mold side container has its pressure decreased to P2 while keeping the pressure of the holding furnace side container at P1, thereby feeding the molten metal into the casting mold.

Providing that a time when charging of the molten metal into the casting mold is confirmed is determined to be T2, from T2 to T3, the pressure in the casting mold side container is kept at P2 and at the same time, the holding furnace side is gradually increased up to P3 to increase the differential pressure and to enhance the feeding head effect, thereby the molten metal is supplied to surroundings of crystals appearing in the process of solidification resulting in preventing casting defects.

Then, after increasing the holding furnace side pressure to a certain pressure P3, the pressures are kept in both containers from T3 to T4 respectively, thereby holding the constant differential pressure between both containers. Further, after T4, the holding furnace side pressure P3 is lowered to be equal with the casting mold side pressure P2, and the differential pressure is dissolved at T5 to return the molten metal to the holding furnace, and after T5, the gas in the containers is discharged to the atmosphere to return to the atmospheric pressure P0 and finally, the casting of one cycle is completed.

With the above pressure control pattern, as shown in FIG. 1, the pressures in both containers before starting the molten metal feeding are increased to P1, which is lower than the maximum pressure P3 of the holding furnace side container. Thus, the casting cycle time is shortened and oxidation of the molten metal in the furnace is prevented in the pressure increasing process, thereby obtaining a good casting.

With the above pressure control pattern, the differential pressure increasing speed ($\Delta P/\Delta T$) is set larger from T2 to T3 than from T1 to T2 as shown in FIG. 2. In the above process, the pressures in both containers and the differential pressure are always monitored from the start to the end of the one cycle casting. The measured values are always fed back to the pressure control means and if the measured values exceed the set values, an exhaust valve is opened to discharge from the containers, so that the pressures in the containers are always kept at the set values.

Figure 3:
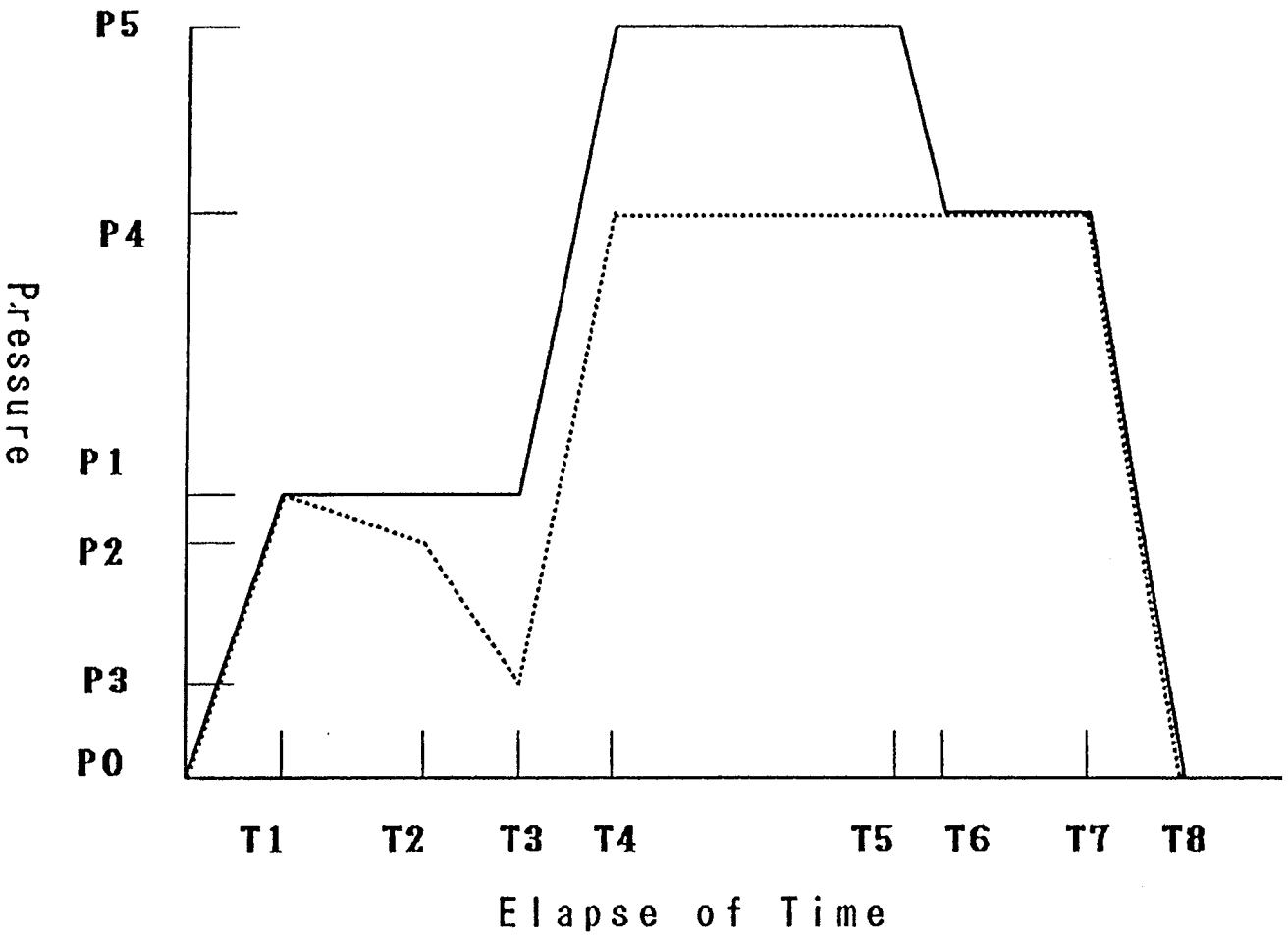
FIG. 3 is a graph showing another example of the pressure control pattern with respect to the holding furnace side container and the casting mold side container according to the present invention.

FIG. 3 shows another example of the pressure control pattern of the casting mold side container and the holding furnace side container according to this invention. The pressures of both containers are increased to P1 from the start of casting to T1, then the pressure of the casting mold side is lowered to P2 while keeping the pressure of the holding furnace side at P1 from T1 to T2, thereby feeding the molten metal into the casting mold. That is, the molten metal in the holding furnace rises in the feeding pipe to be charged in the casting mold. The charged molten metal is cooled by releasing heat to the casting mold and solidification progresses from the position separated from the sprue toward the sprue with time.

Providing that a time when the charging of the molten metal into the casting mold is confirmed is determined to be T2, the pressure in the casting mold side container is more quickly decreased to P3 from T2 to T3, then after decreasing the casting mold side pressure to P3, the pressures in both containers are simultaneously increased at the same speed in the range of T3 to T4, thereby holding the differential pressure between both containers at a certain level. Then, after T4, both containers are held at certain pressures respectively to keep the differential pressure. Further, after T5, the holding furnace side pressure is decreased to the same level with the casting mold side pressure, and at T6, the differential pressure dissolved and the molten metal is returned to the holding furnace, then after T7, the gas in the containers is discharged into the atmosphere to return to the atmospheric pressure and the casting of one cycle is completed.

In the above pressure control pattern, the pressures in both containers at the start of feeding of the molten metal are P1, and this corresponds to about 30% of the maximum pressure Pf-max (PS) in the holding furnace side container. Thus, the casting cycle time is shortened and at the same time, oxidation of the molten metal in the furnace on the pressure increasing process is prevented, thereby obtaining a good casting. This pressure control pattern is applied when a strong part such as an aluminum wheel is cast by using the molten metal of Al—Si—Mg composition.

When pressures P1 in both containers are set to about 20% of the maximum pressure Pf-max (P5) in the holding furnace side container at the start of feeding in the above pressure control pattern, this pattern is applicable when a corrosion resistant part is cast by using the molten metal of Al—Mg composition.

Figure 4:
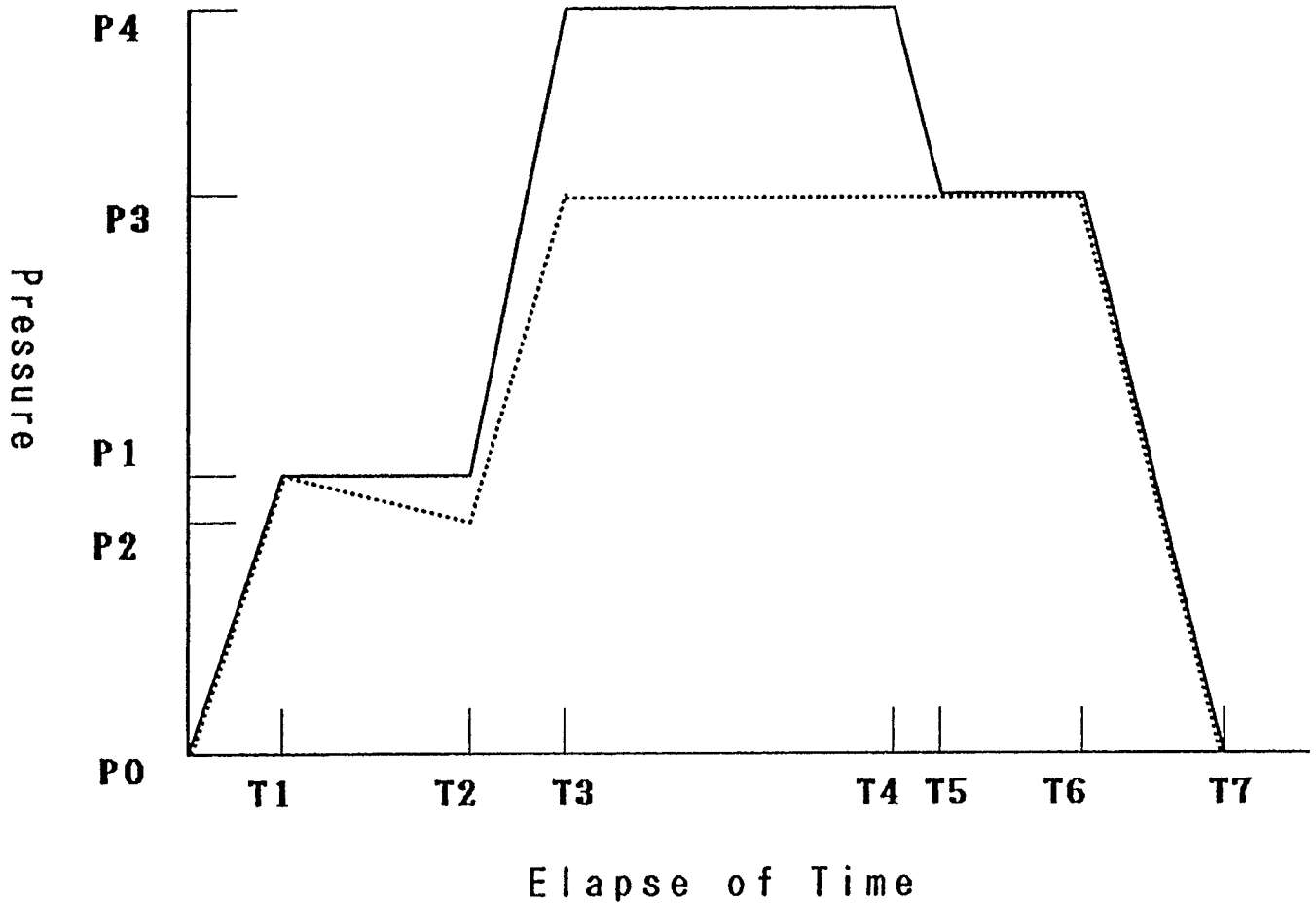
FIG. 4 is a graph showing yet another example of the pressure control pattern with respect to the holding furnace side container and the casting mold side container according to the present invention.

FIG. 4 shows another example of the pressure control pattern of the casting mold side container and the holding furnace side container according to this invention. Both containers have the pressures increased to P1 in a range from the start to T1, then the pressure of the casting mold side is lowered to P2 while keeping the pressure of the holding furnace side at P1. Thus, the molten metal in the holding furnace rises in the feeding pipe and is charged in the casting mold, and the charged molten metal is cooled by releasing heat to the casting mold and starts solidification.

Then, providing that a time when the charging of the molten metal into the casting mold is confirmed is determined to T2, the pressures in both containers are increased in a range from T2 to T3 respectively, and the differential pressure is increased by the difference of pressure increasing degree. Then, after increasing both container pressures to P3 and P4 respectively, both containers are kept unchanged from T3 to T4 to hold the differential pressure at a certain level. Then, after T4, the holding furnace side pressure is lowered to be identical with the casting mold side pressure, and at T5, the differential pressure is dissolved and the molten metal is returned to the holding furnace, and after T6, the gas in the pressure containers is discharged into the atmosphere to return to the atmospheric pressure and the casting of one cycle is completed.

In above pressure control pattern, the pressures in both containers at the start of feeding are P1, and this corresponds to about 30% of the maximum pressure Pf-max (P4) of the holding furnace side container. This pressure control pattern is suitable when a complicated-shaped part such as an engine block is cast using the molten metal of Al—Si—Cu composition.

Figure 5:
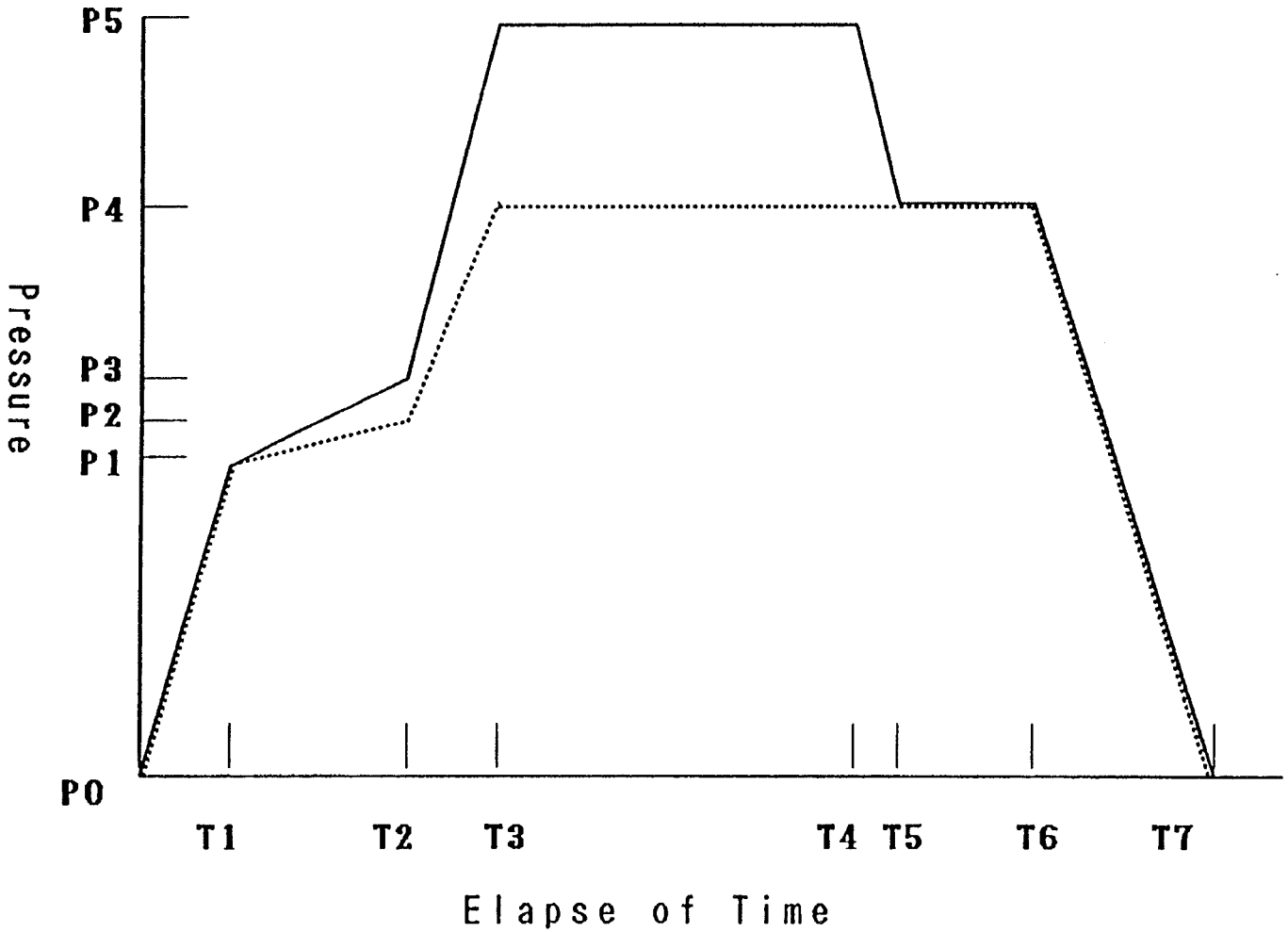
FIG. 5 is a graph showing another example of the pressure control pattern with respect to the holding furnace side container and the casting mold side container according to the present invention.

FIG. 5 shows still another example of the pressure control pattern of the casting mold side container and the holding furnace side container according to this invention. Both containers have the pressures increased to P1 in a range from the start to T1, then the pressure increasing speed of both containers is lowered and at the same time, the differential pressure is generated relatively between both containers by the difference of the pressure increase degree in both containers. Thus, the molten metal in the holding furnace rises the feeding pipe and is charged into the casting mold.

Then, the casting mold side pressure container and the holding furnace side pressure container are respectively increased to P2 and P3. Providing that a time when charging of the molten metal into the casting mold is confirmed is determined to be T2, from T2 to T3, both containers have pressures quickly increased to P4 and P5 respectively and according to the difference of pressure increasing degree, the differential pressure is more increased, then both containers are kept constant from T3 to T4 to hold the differential pressure at a certain level. Then, after T4, the holding furnace side pressure is lowered to be identical with the casting mold side pressure, and at T5, the differential pressure is resolved and the molten metal is returned to the holding furnace. After T6, the gas in the pressure containers is discharged to the atmosphere to return to the atmospheric pressure and the casting of one cycle is completed.

In the above pressure control pattern, the pressures in both containers at the start of molten metal feeding are P1, and this corresponds to about 30% of the maximum pressure Pf-max (P5) of the holding furnace side container. This pressure control pattern is applied when a thick wall part is cast by using the molten metal of Al—Cu composition.

Figure 6:
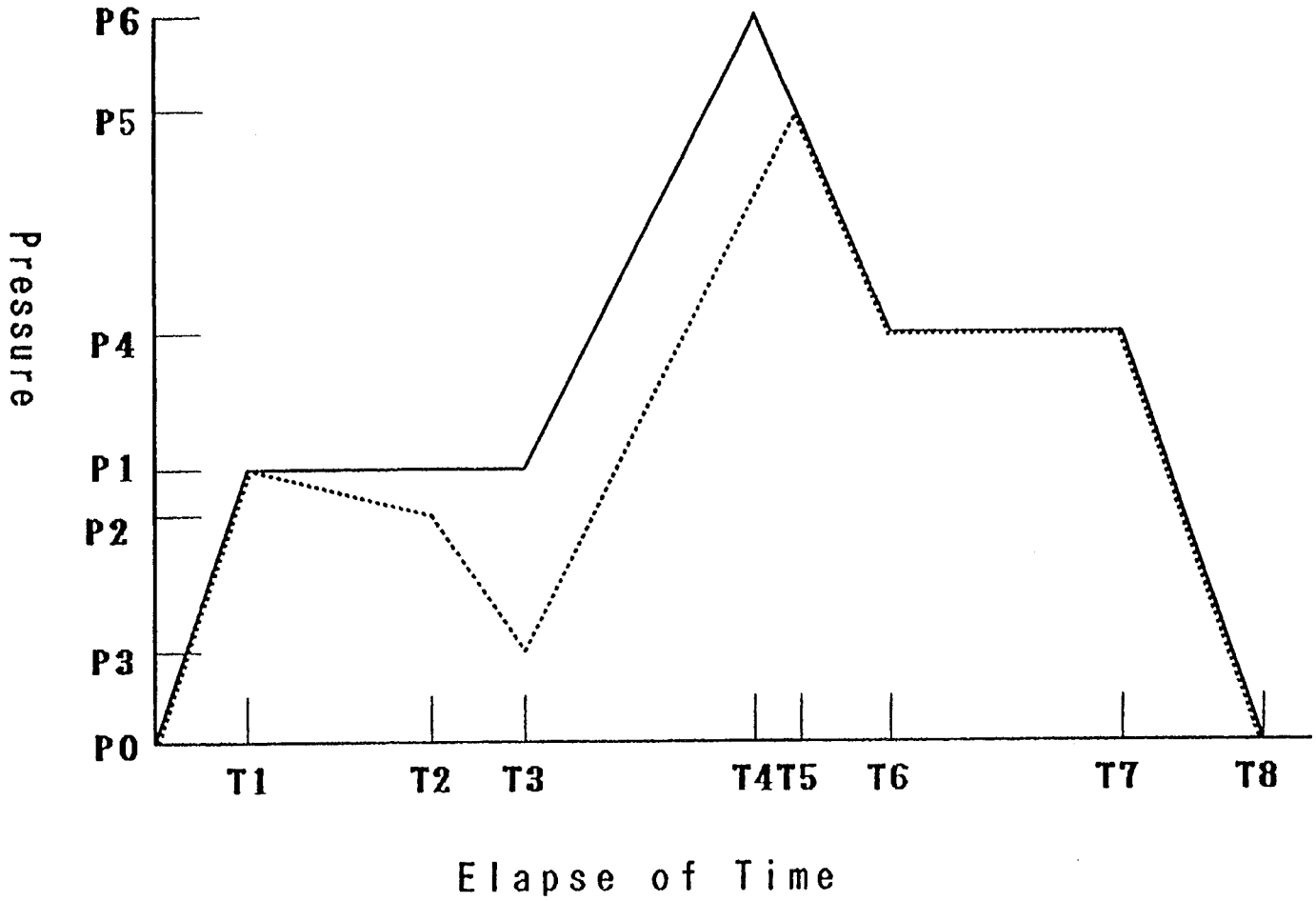
FIG. 6 is a graph showing still another example of the pressure control pattern with respect to the holding furnace side container and the casting mold side container according to the present invention.

FIG. 6 shows still another example of the pressure control pattern of the casting mold side container and the holding furnace side container according to this invention. Both containers have the pressures increased to P1 in a range from the start to T1, then the pressure of the casting mold side is lowered to P2 while keeping the pressure of the holding furnace side at P1, thereby feeding the molten metal into the casting mold. Then, after the casting mold side is decreased to P2, the pressure in the casting mold side container is more quickly lowered to P3 from T2 to T3. Then, both containers have the pressures increased simultaneously at the same speed from T3 to T4, thereby the differential pressure between both containers is kept at a certain level. Then, after T4, the holding furnace side pressure is lowered to be identical with the casting mold side pressure, and at T5, the differential pressure is dissolved and the molten metal is returned to the holding furnace. Further, both containers have the pressures lowered to P4, and after T6, both container pressures are held at a certain level. Further, after T7, the gas in both containers is discharged to the atmosphere to return to the atmospheric pressure and the casting of one cycle is completed.

In the above pressure control pattern, the pressures of both containers at the start of the molten metal feeding are P1, and this correspond to about 20% of the maximum pressure Pf-max (P6) of the holding furnace side container. This pressure control pattern is applicable when a large strong part is cast by using the molten metal of Al—Cu—Mg composition.

In the above pressure control pattern, the maximum pressure of the holding furnace side container is Pf-max (P6), and the maximum pressure of the casting mold side container is Pm-max (P5). These are set higher compared with the maximum pressure of other pressure control patterns mentioned before. Crystalline particles of the casting can be made fine and its toughness is to be enhanced by applying such a high pressure in the solidification process of the molten metal.

Figure 7:
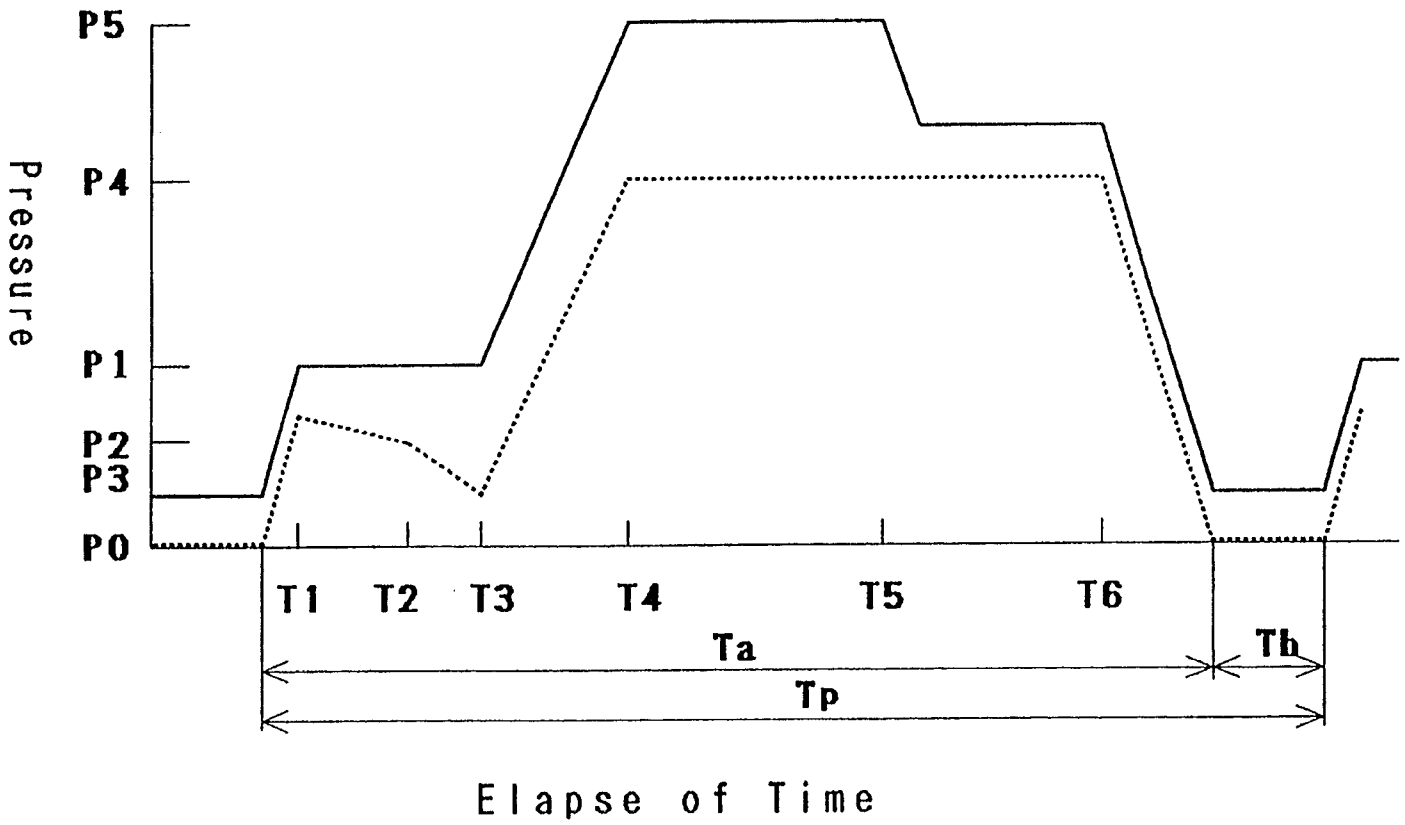
FIG. 7 is a graph showing also another example of the pressure control pattern with respect to the holding furnace side container and the casting mold side container according to the present invention.

FIG. 7 shows another example of the pressure control pattern of the casting mold side container and the holding furnace side container according to this invention. The holding furnace side container is always applied with a certain pressure higher than the atmospheric pressure, and the free surface of the molten metal is designed to be positioned slightly lower than the sprue of tile casting mold in the molten metal feeding pipe. The holding furnace side container has its pressure increased to P1 at the same pressure increasing speed with that of the casting mold side container in a range from the start to T1, then the pressure of the casting mold side is lowered to P2 while keeping the pressure of the holding furnace side at P1. Thus, the molten metal is fed into the casting mold, and charged molten metal is cooled by releasing heat to the casting mold to progress solidification.

Then, providing that a time when the charging of the molten metal into the casting mold is confirmed is determined to be T2, the pressure in the casting mold side container is more quickly lowered to P3 in a range from T2 to T3. The pressures of both containers are increased simultaneously at the same speed from T3 to T4, thereby maintaining the differential pressure of both containers to a certain level. Then after T4, both containers are retained at P4 and P5 respectively to keep the constant differential pressure. Further, after T5, the holding furnace side pressure is lowered to a pressure which is about 0.15 kgf/cm$^2$ higher than the casting mold side pressure to return the molten metal so that the molten metal free surface is positioned near the sprue of the casting mold in the molten metal feeding pipe. After T6, the pressure in the holding furnace side container is decreased to a certain level higher than the atmospheric pressure and the pressure in the casting mold side container is decreased to the atmospheric pressure.

In the above control pattern, the pressure of the holding furnace side container is increased to P1 before the start of molten metal feeding, and this corresponds to a range of 15 to 40% of the maximum pressure Pf-max (P5) of the holding furnace side container. This pressure control pattern is applied to the casting of an aluminum wheel by using the molten metal of Al—Si—Mg composition.

In the above pressure control pattern, when pressure P1 of the holding furnace side container is set in a range of 5 to 25% of the maximum pressure Pf-max (P5) of the holding furnace side container, such a pressure control pattern is applicable to the casting of a corrosion resistant part by using the molten metal of Al—Mg composition.

Figure 8:
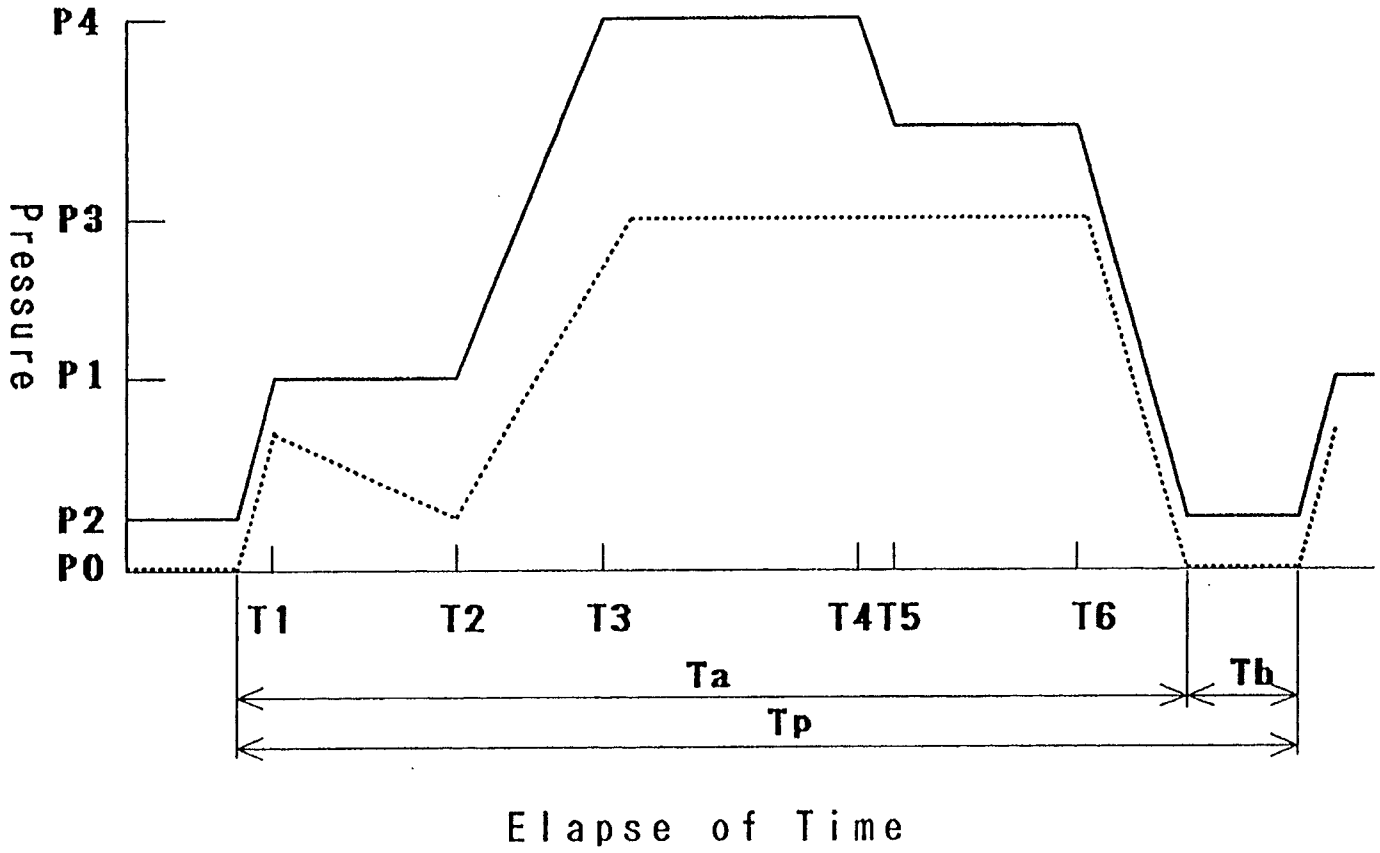
FIG. 8 is a graph showing another example of the pressure control pattern with respect to the holding furnace side container and the casting mold side container according to the present invention.

FIG. 8 shows another example of the pressure control pattern of the casting mold side container and the holding furnace side container according to this invention. The holding furnace side container, which is always applied with a certain pressure more than the atmospheric pressure so that the molten metal free surface is positioned near the sprue of the casting mold in the molten metal feeding pipe, has the pressure increased to P1 at the same increasing speed with the casting mold side from the start to T1, then the pressure of the casting mold side is lowered to P2 keeping the pressure of the holding furnace side at P1. Thereby, the molten metal is fed into the casting mold and the charged molten metal is cooled by releasing heat to the casting mold to start solidification.

Then, providing that a time when the charging of the molten metal into the casting mold is confirmed is determined to be T2, the pressures in both containers are increased to P3 and P4 respectively in a range from T2 to T3, and by the difference of pressure increase degree, the differential pressure is quickly increased. Then, the pressures of both containers are held at P3 and P4 respectively from T3 to T4 to hold the differential pressure at a certain level. Then, after T4, the holding furnace side pressure is lowered to a pressure which is about 0.15 kgf/cm$^2$ higher than the casting mold side pressure to return the molten metal so that the free surface of the molten metal is positioned near the sprue of the casting mold in the molten metal feeding pipe. After T6, the pressure in the holding furnace side container is decreased to a certain level higher than the atmospheric pressure and the pressure in the casting mold side container is decreased to the atmospheric pressure.

With the above pressure control pattern, the pressure in the holding furnace side container is increased to P1 before starting the feeding of molten metal and this corresponds to a range of 5 to 25% of the maximum pressure Pf-max (P4) of the holding furnace side container. This pressure control pattern is particularly suitable for casting an engine block by using the molten metal of Al—Si—Cu composition.

Figure 9:
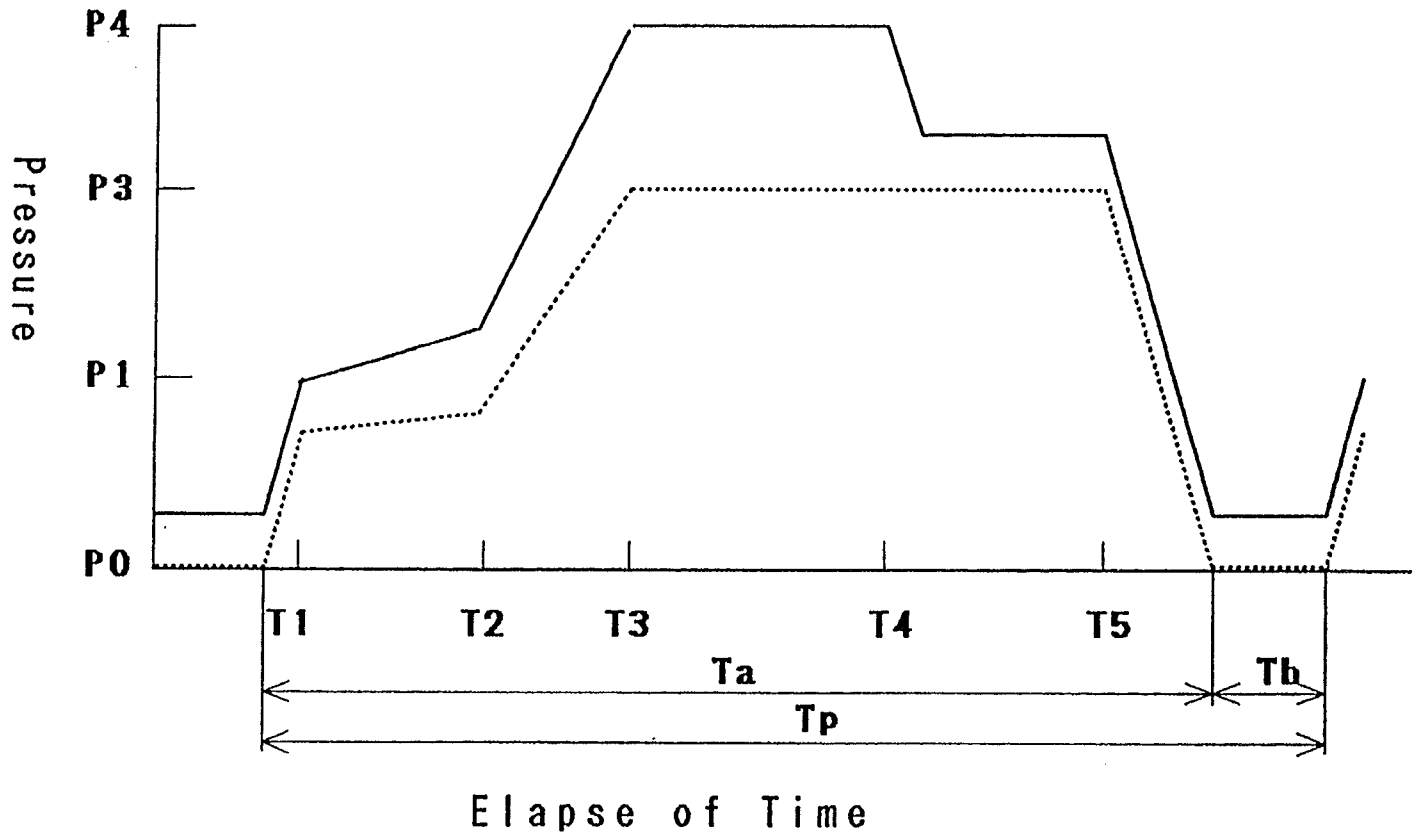
FIG. 9 is a graph showing another example of the pressure control pattern with respect to the holding furnace side container and the casting mold side container according to the present invention.

FIG. 9 shows still another example of the pressure control pattern of the casting mold side container and the holding furnace side container according to this invention. The holding furnace side container, which is always applied a certain pressure over the atmospheric pressure so that the molten metal free surface is positioned near the sprue of the casting mold in the molten metal feeding pipe, has the pressure increased to P1 at the same increasing speed with the casting mold side from the start to T1, then the pressure increasing speed in both containers is lowered and the differential pressure is relatively generated between both containers depending on the difference of the pressure increase degree. Thus, the molten metal is fed into the casting mold.

Then, providing that a time when the charging of the molten metal into the casting mold is determined to be T2, both containers are quickly increased their pressures to P3 and P4 respectively and the differential pressure is further increased depending on the difference of the pressure increasing degree from T2 to T3, then after T3, both containers are kept statically from T3 to T4 to keep the differential pressure at a certain level. Then, after T4, the holding furnace side is lowered to a pressure about 0.15 kgf/cm$^2$ higher than the casting mold side pressure so that the molten metal is returned and its free surface is positioned near the sprue of the casting mold in the molten metal feeding pipe. After T5, the pressure in the holding furnace side container is decreased to a certain level higher than the atmospheric pressure and the pressure in the casting mold side container is decreased to the atmospheric pressure.

In the above pressure control pattern, the pressure in the holding furnace side container before the start of the molten metal feeding is increased to P1, and this corresponds to a range of 5 to 25% of the maximum pressure Pf-max (P4) in the holding furnace side container. This pressure control pattern is particularly suitable for casting a thick wall part by using the molten metal of Al—Cu composition.

Figure 10:
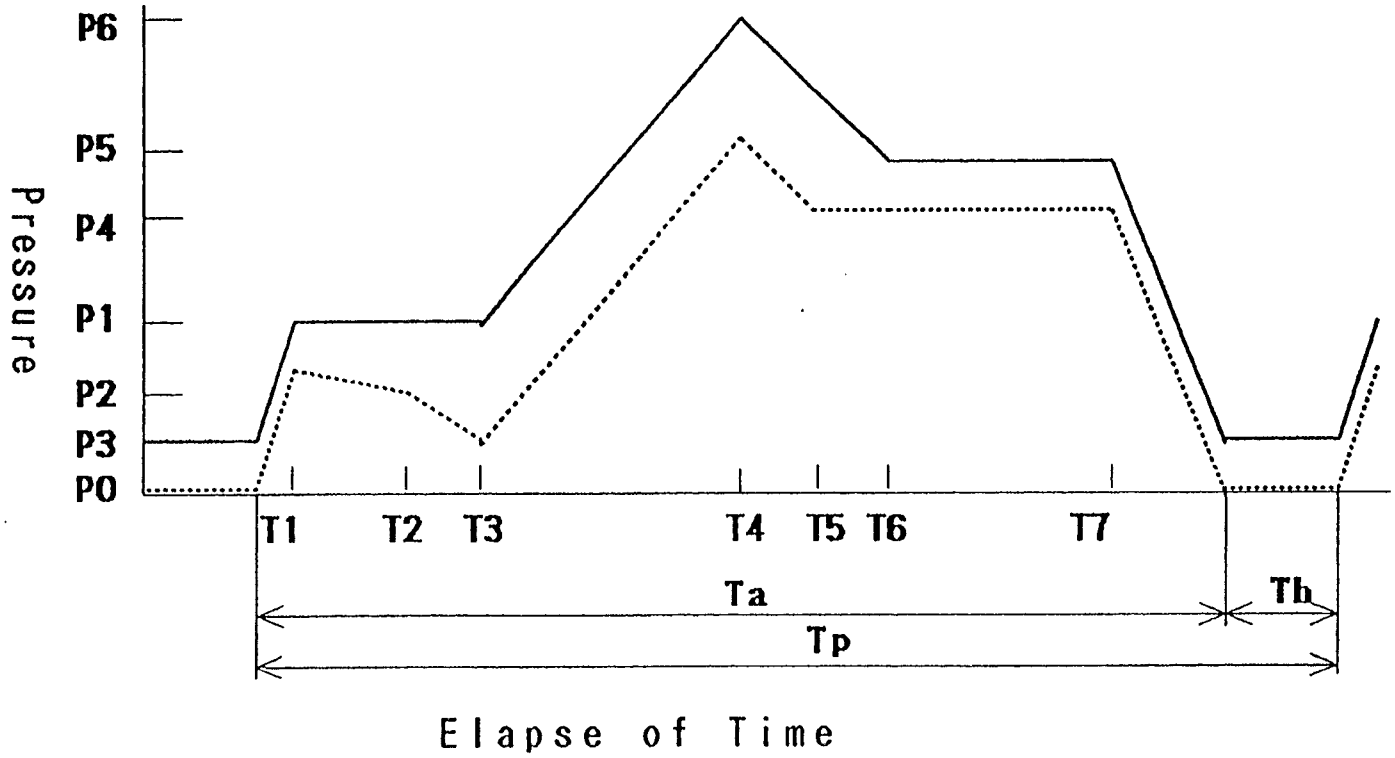
FIG. 10 is a graph showing another example of the pressure control pattern with respect to the holding furnace side container and the casting mold side container according to the present invention.

FIG. 10 also shows another example of the pressure control pattern of the casting mold side container and the holding furnace side container according to this invention. The holding furnace side container, which is always applied a certain pressure over the atmospheric pressure so that the molten metal free surface is positioned near the sprue of the casting mold in the molten metal feeding pipe, has its pressure increased to P1 at the same pressure increasing speed with that in the casting mold side container in a range from the start to T1, then the pressure of the casting mold side is lowered to P2 while keeping the pressure of the holding furnace side at P1. Thus, the molten metal is fed into the casting mold.

Then, providing that a time when the charging of the molten metal into the casting mold is determined to be T2, the pressure in the casting mold side container is more quickly lowered to P3 in a range from T2 to T3. The pressures of both containers are increased simultaneously at the same speed from T3 to T4, thereby maintaining the differential pressure between both containers to a certain level. Then, after T4, both containers have lowered their pressures keeping the differential pressure at the same level. The pressure reduction of the casting mold side is stopped at T5, while the pressure of the holding furnace side is continuously lowered so that the differential pressure of about 0.15 kgf/cm$^2$ is formed, thereby the molten metal is returned and its free surface is positioned near the sprue of the casting mold in the molten metal feeding pipe. After T6, both container pressures are retained at a certain level. Further, after T7, the pressure in the holding furnace side container is decreased to a certain level higher than the atmospheric pressure and the pressure in the casting mold side container is decreased to the atmospheric pressure.

In the above pressure control pattern, the pressure of the holding furnace side container is increased to P1 before starting the molten metal feeding, and this corresponds to a range of 5 to 25% of the maximum pressure Pf-max (P6) of the holding furnace side. This pressure control pattern is particularly suitable for casting a strong part by using the molten metal of Al—Cu—Mg composition.

In the above pressure control pattern, the maximum pressure of the holding furnace side container is Pf-max (P6), and the maximum pressure of the casting mold side container is Pm-max (PS). These are set higher compared to the maximum pressures of other pressure control patterns mentioned before. Crystalline particles of the casting can be made fine and its toughness is to be enhanced by applying such a high pressure in the solidification process of the molten metal.

Figure 11:
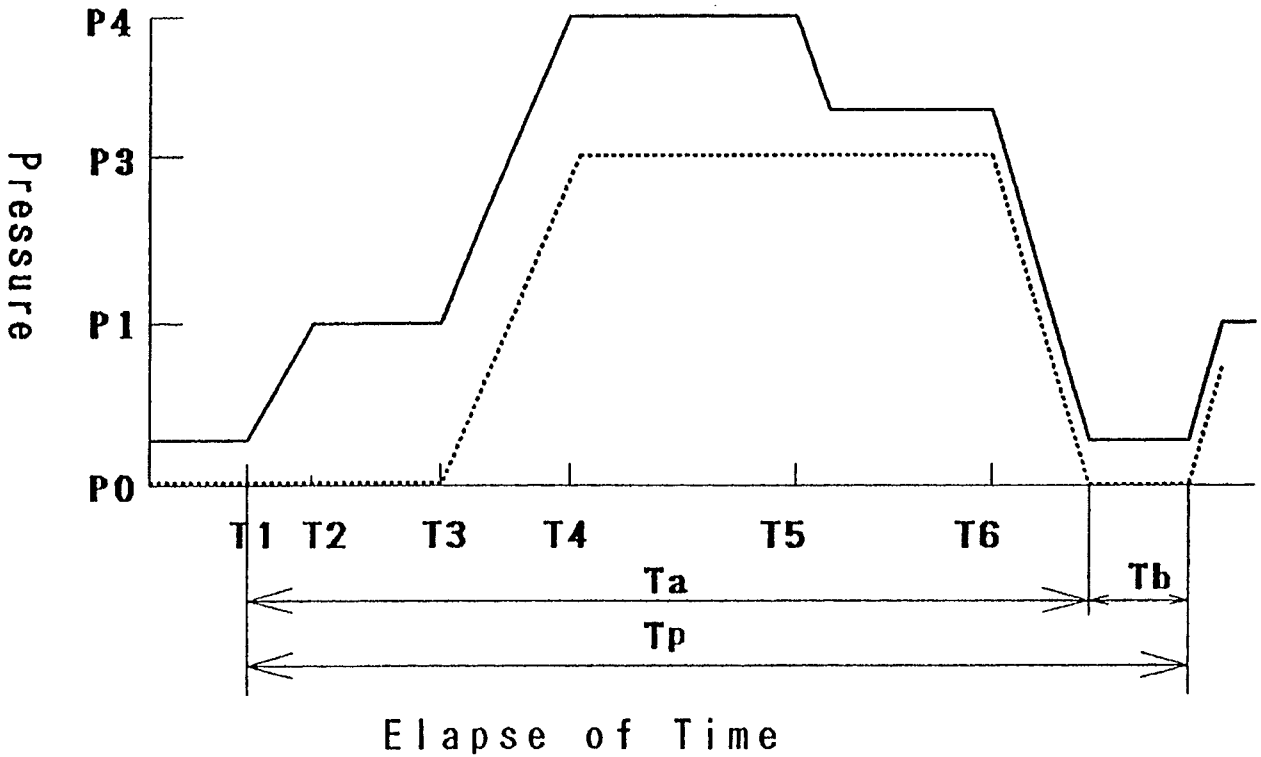
FIG. 11 is a graph showing still another example of the pressure control pattern with respect to the holding furnace side container and the casting mold side container according to the present invention.

FIG. 11 shows another example of the pressure control pattern of the casting mold side container and the holding furnace side container according to this invention. The holding furnace side container, which is always applied a certain pressure over the atmospheric pressure so that the molten metal free surface is positioned near the sprue of the casting mold in the molten metal feeding pipe, has its pressure increased to P1 for from T1 to T2. Thus, the molten metal is fed into the casting mold. Then, providing that a time when the charging of the molten metal into the casting mold is determined to be T2, the pressure of the holding furnace side is retained at P1 to apply the constant pressure to the charged molten metal for from T2 to T3.

Then, the pressures of the holding furnace side container and the casting mold side container are simultaneously increased at the same speed, thereby keeping a certain differential pressure between both containers from T3 to T4. Then, both containers have their pressures kept statically so that the differential pressure is kept the same from T4 to T5. After T5, the holding furnace side pressure is lowered to a pressure about 0.15 kgf/cm$^2$ higher than the casting mold side pressure, thereby the molten metal is returned and the molten metal free surface is positioned near the sprue of the casting mold in the molten metal feeding pipe. After T6, the pressure in the holding furnace side container is decreased to a certain level higher than the atmospheric pressure and the pressure in the casting mold side container is decreased to the atmospheric pressure.

Figure 12:
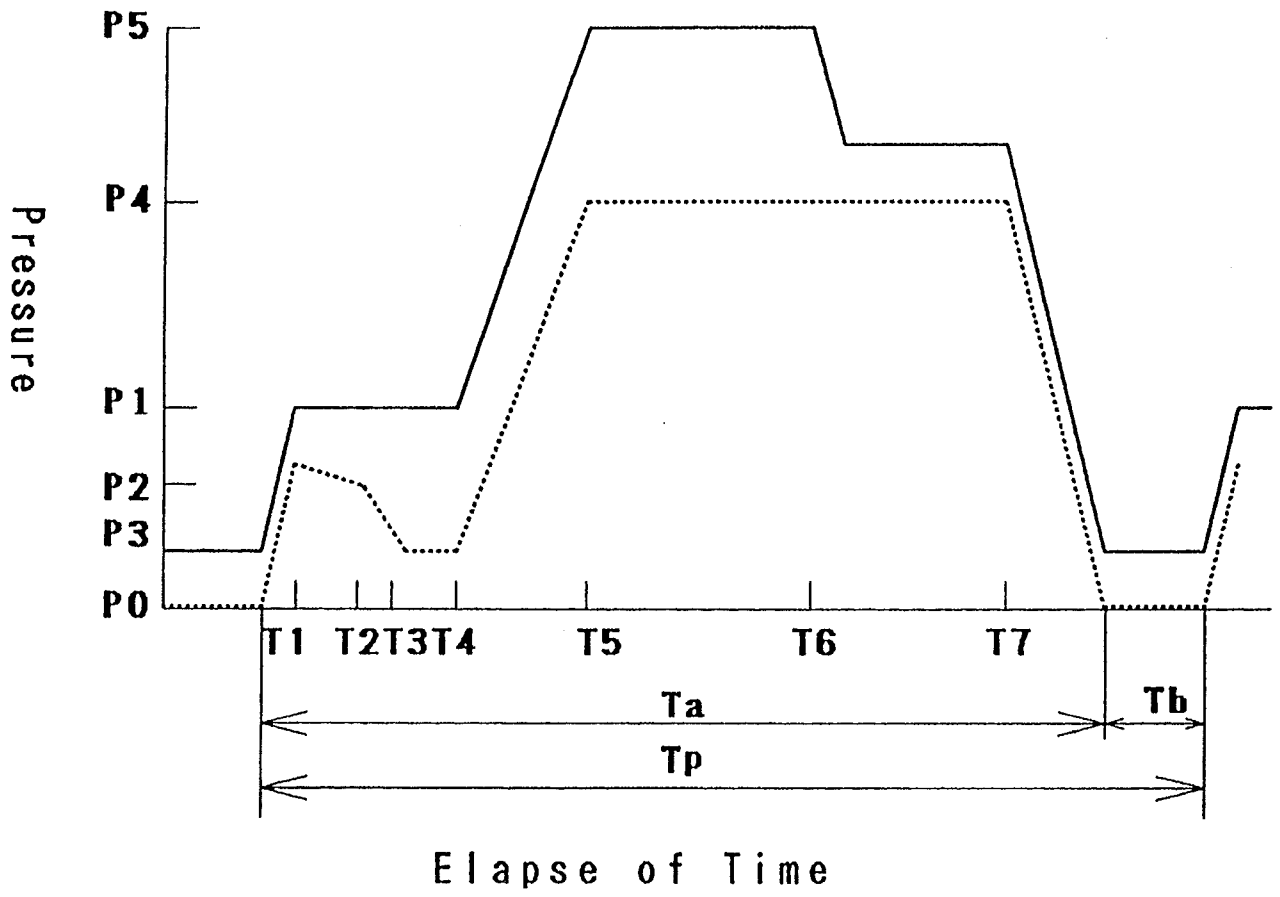
FIG. 12 is a graph showing another example of the pressure control pattern with respect to the holding furnace side container and the casting mold side container according to the present invention.

FIG. 12 shows another example of the pressure control pattern of the casting mold side container and the holding furnace side container according to this invention. The holding furnace side container is always applied a certain pressure higher than the atmospheric pressure so that the free surface of the molten metal is positioned near the sprue of the casting mold in the molten metal feeding pipe. The holding furnace side container has its pressure increased to P1 at the same pressure increasing speed with that of the casting mold side container in a range from the start to T1, then the pressure of the casting mold side is lowered to P2 while keeping the pressure of the holding furnace side at P1 from T1 to T2, Thus, the molten metal is fed into the casting mold.

Then, the casting mold side pressure is more quickly lowered to P3 in a range from T2 to T3. Providing that a time when the charging of the molten metal into the casting mold is determined to T3, the pressure in the casting mold side is kept at a low pressure of 0 to 3 kg/cm$^2$ to apply such a low pressure to the charged molten metal until T4. The pressures of both containers are respectively increased to P4 and P5 at the same speed from T4 to T5, thereby maintaining the differential pressure between both containers. Then, after T5, both containers are retained at P4 and P5 to keep the constant differential pressure. Further, after T6, the holding furnace side pressure is lowered to a pressure which is about 0.15 kgf/cm$^2$ higher than the casting mold side pressure to return the molten metal so that the molten metal free surface is positioned near the sprue of the casting mold in the molten metal feeding pipe. After T7, the pressure in the holding furnace side container is decreased to a certain level higher than the atmospheric pressure and the pressure in the casting mold side container is decreased to the atmospheric pressure.

According to the methods shown in FIG. 11 and FIG. 12, the pressure increase to the maximum pressures in both containers is effected after the solidification of a portion where local concentration of casting defects tend to be observed, for example a thin wall portion with a complicated shape. This contributes to the prevention of such defects caused by the pressure increase in an early stage before the solidification of such a portion, thereby a good casting free from defects is obtained.

the counter pressure casting by the pressure control pattern shown in the above FIG. 7 to FIG. 12, the casting cycle time Tp is determined as the sum of the casting time Ta and the casting removal time Tb. The casting time Ta can be made shorter than a conventional casting time Tc shown in FIG. 18 because the holding furnace side container interior is always held above the atmospheric pressure resulting in the total casting cycle time shortening.

As described above, according to the counter pressure casting and counter pressure casting device of this invention, the following advantages are obtained in the casting process.

By communicating the casting mold side container and the holding furnace side container and increasing the pressures of both containers to a certain level, the nucleus generation of the hydrogen gas in the molten metal is controlled, then with generating and increasing the differential pressure between both containers by reducing the casting mold side pressure after the communication valve of each pressure container is closed to separate each other, the molten metal is fed to the casting mold by the suction force due to the differential pressure. Thus, the run of the molten metal into the casting mold is remarkably improved. In addition, high feeding head effect can be obtained by relatively increasing the internal pressure of the holding furnace side container, which contributes to the prevention of casting defects occurrence at the time of solidification, and a good casting can be obtained.

The absolute pressures which are needed in the casting within both pressure containers are applied in the process after charging the molten metal into the casting mold, and the pressures in the containers at the start of molten metal charging into the casting mold is set to a low pressure compared with the maximum pressure. Thereby, the casting cycle time can be shortened because less pressurizing time in the container before the molten metal charging is necessary compared with the conventional counter pressure casting and also adverse effects such as stirring and oxidation of the molten metal in the furnace can be prevented as the velocity of the air current blown into the holding furnace side container and the gas volume can be made small before the start of molten metal charging.

The charged molten metal in the casting mold starts to solidify and the outer skin is formed near the casting mold. When the outer skin is once formed, the action of the suction force to the molten metal is lowered, resulting in poor run of the molten metal to the casting mold. In order to avoid such a problem, upon the completion of feeding the molten metal into the casting mold, the casting mold side container is more quickly lowered to improve the differential pressure increasing speed between the casting mold side container and the holding furnace side container so that the action of the suction force to the molten metal is maintained and the run of the molten metal to the casting mold is kept.

Similarly, when the inner pressure of the holding furnace side container is relatively increased after charging the casting mold with the molten metal, a high feeding head effect can be obtained. Thus, the casting defects can be prevented from occurring during solidification, resulting in a good casting.

Further, by maintaining the pressure in the furnace side container slightly higher than the atmospheric pressure after the completion of casting of one cycle, the free surface of the molten metal stays near the sprue of the casting mold in the molten metal feeding pipe. As a result, a time loss due to the feeding and returning of the molten metal between the holding furnace and the casting mold can be remedied, and the casting time can be made shorter than that by the conventional method, resulting in remarkable shortening of the casting time.

In addition, stirring of the molten metal in the holding furnace due to the returning of the molten metal from the casting mold to the holding furnace can be prevented, and casting conditions can be maintained as the molten metal free surface is positioned statically.

Furthermore, by holding the pressure in the holding furnace side container at a certain level for a certain time or applying a low pressure in a certain range to the casting mold side container after the molten metal charging, a high feeding head effect can be obtained, and casting defects particularly observed in a thick wall section can be prevented during solidification, resulting in a good casting.

In addition, the pressure increase to the maximum pressures in both containers is effected after the solidification of a portion where local concentration of casting defects tend to be observed, for example a thin wall portion with a complicated shape. This contributes to the prevention of such defects, thereby a good casting free from defects is obtained.

The present invention is now described below based on specific examples and embodiments, but the present invention is not to be construed as being limited thereto.

EXAMPLE 1

Figure 13:
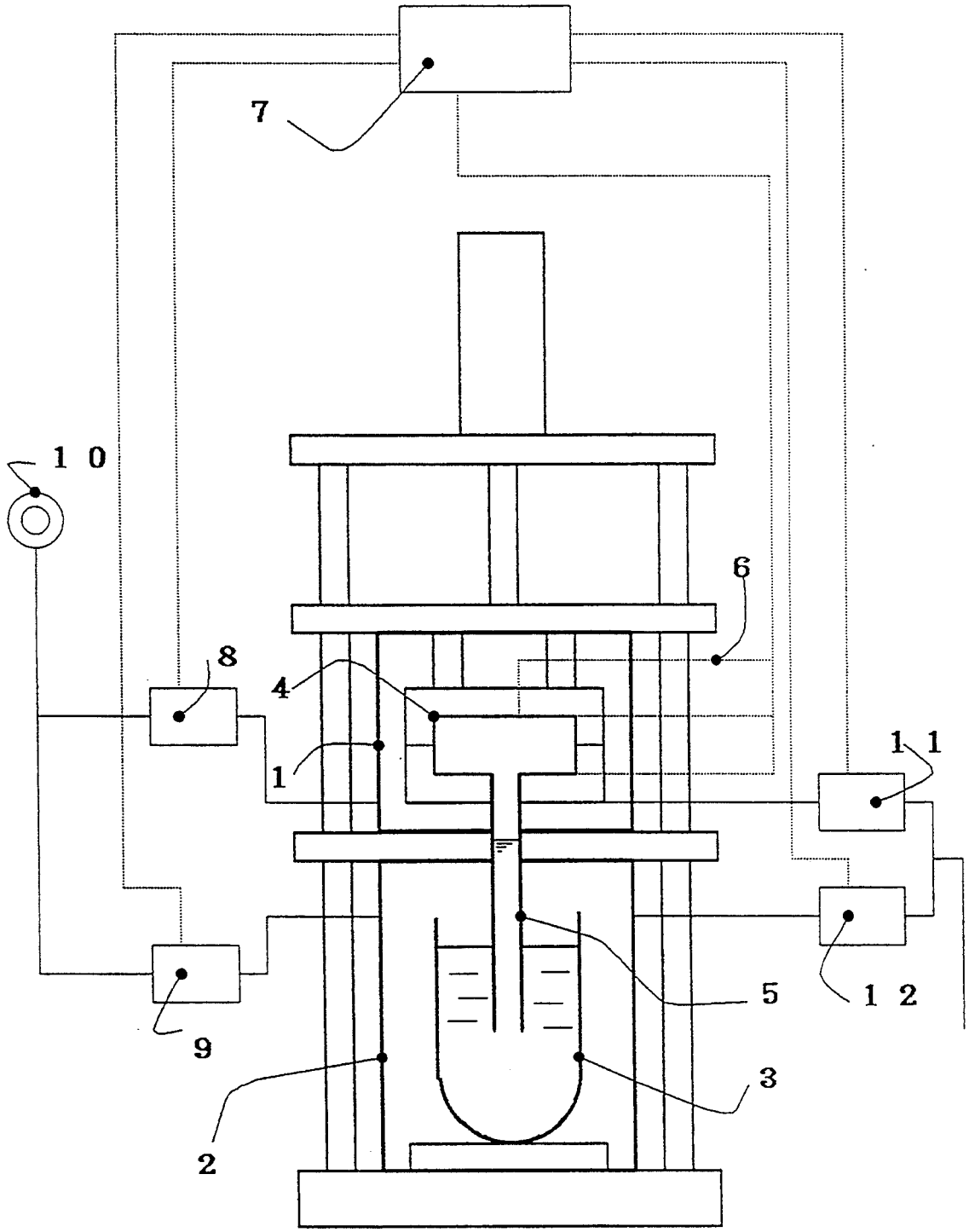
FIG. 13 is an explanatory view showing a counter pressure casting device of this invention.

FIG. 13 shows the counter pressure casting device of this invention, wherein a casting mold 4 is disposed in a casting mold side pressure container 1 and a holding furnace 3 in a holding furnace side pressure container 2. The molten metal in the holding furnace 3 is fed into the casting mold 4 through a feeding pipe 5, which is communicating the holding furnace 3 and the casting mold 4, by the differential pressure between the pressure containers 1 and 2. A plurality of thermocouples 6 is disposed in the casting mold 4 to measure the surface temperature of a casting, and measurements by these thermocouples 6 are inputted in a pressure control device 7. Numbers and position of these thermocouples 6 are determined according to the kind, the shape and the size of a subject casting. Generally, the thermocouples 6 are disposed at constant intervals according to a distance from a sprue to the farthest end in the vertical cross section of the casting mold containing the sprue.

Pressure means 8 and 9 are disposed on the sides of the casting mold 4 and the holding furnace 3, respectively.

Control signals are outputted from the pressure control device 7 to the above pressure means 8 and 9, the pressurized gas from a pressurized gas source 10 is supplied to the casting mold side container 1 and the holding furnace side container 2 through the pressure means 8 and 9, and each pressure of the containers 1 and 2 is independently controlled.

In addition, discharge means 11 and 12 are opened or closed independently or as interlocked according to the signals from the pressure control device 7 to discharge gas from each container.

In the above, the pressure control device 7 is previously provided with a program to execute the following (1) through (4) independently or in combination partly-/in all simultaneously.

(1) The pressures in the casting mold side container and holding furnace side container are determined to be 0 to 50% of the maximum pressure of both pressure containers when feeding of the molten metal into the casting mold is started.

(2) After the completion of feeding the molten metal into the casting mold 4, the differential pressure between both containers 1 and 2 is further increased at a high speed.

(3) A pressure slightly higher than the atmospheric pressure is arranged to be applicable usually to the furnace side container.

(4) Before starting the molten metal charging process, the pressure of the casting mold side container 1 is kept at the atmospheric pressure while the holding furnace side container 2 only is pressurized to charge the molten metal into the casting mold.

In each example, the pressures and differential pressure of the pressure containers are always monitored from the start to the completion of the casting, and when the differential pressure or pressures exceed the prescribed value, the above discharge means 11 and 12 are released to discharge, and also the measurements are fed back to the above pressure control device 7 to maintain the set pressure value.

Using the device shown in FIG. 13, an aluminum alloy casting was produced by being pressurized up to 6 kgf/cm $^2$ in maximum according to the pressure control pattern shown in FIG. 1. The pressures in both containers 1 and 2 were increased up to 5 kgf/cm$^2$ in the process of pressurizing from the atmospheric pressure to P1 by T1. Then, the pressure in the casting mold side was gradually lowered while keeping the pressure in the holding furnace side so that the molten metal was fed into the casting mold from T1 to T2. Then, providing that a time when the charge of the molten metal into the casting mold was confirmed by the thermocouples 6 disposed at the top of the cavity was determined to be T2, the pressure in the casting mold side container was kept constant from T2 to T5. The holding furnace side pressure was gradually increased and held at the maximum from T2 to T4. After T4, the holding furnace side pressure was lowered to the same level with the casting mold side pressure to resolve the differential pressure from T4 to T5, thereby the molten metal was returned to the holding furnace. After T5, the pressures in both containers were reduced to the atmospheric pressure discharging the gas in the containers to the atmosphere, thus completing the casting of one cycle.

The results obtained by evaluating characteristics of the casting are shown in Table 1.

COMPARATIVE EXAMPLE 1

Figure 18:
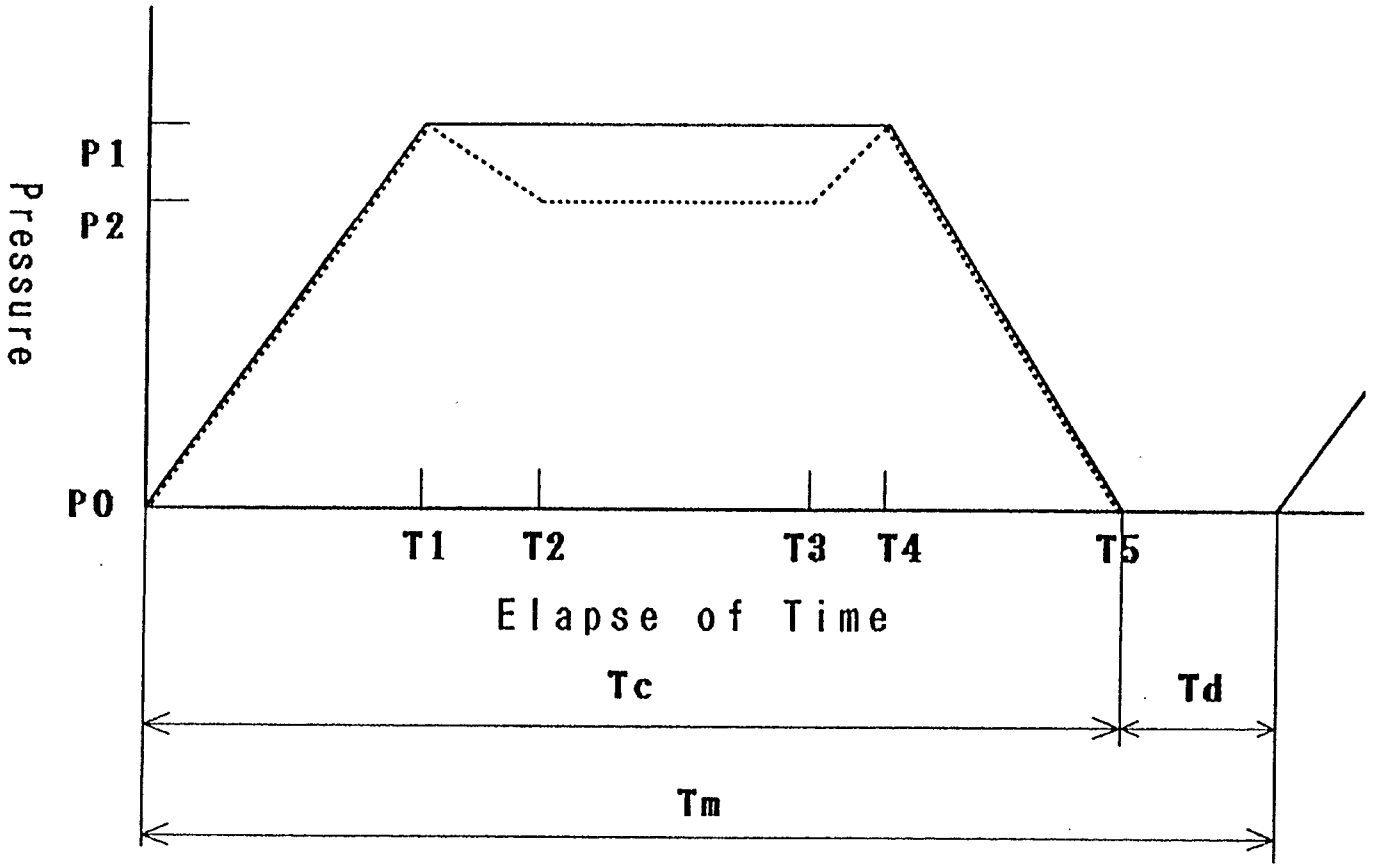
FIG. 18 PRIOR ART
FIG. 18 is a graph showing the pressure control, pattern with respect to the holding furnace side container and the casting mold side container according to the conventional counter pressure casting.
Figure 19:
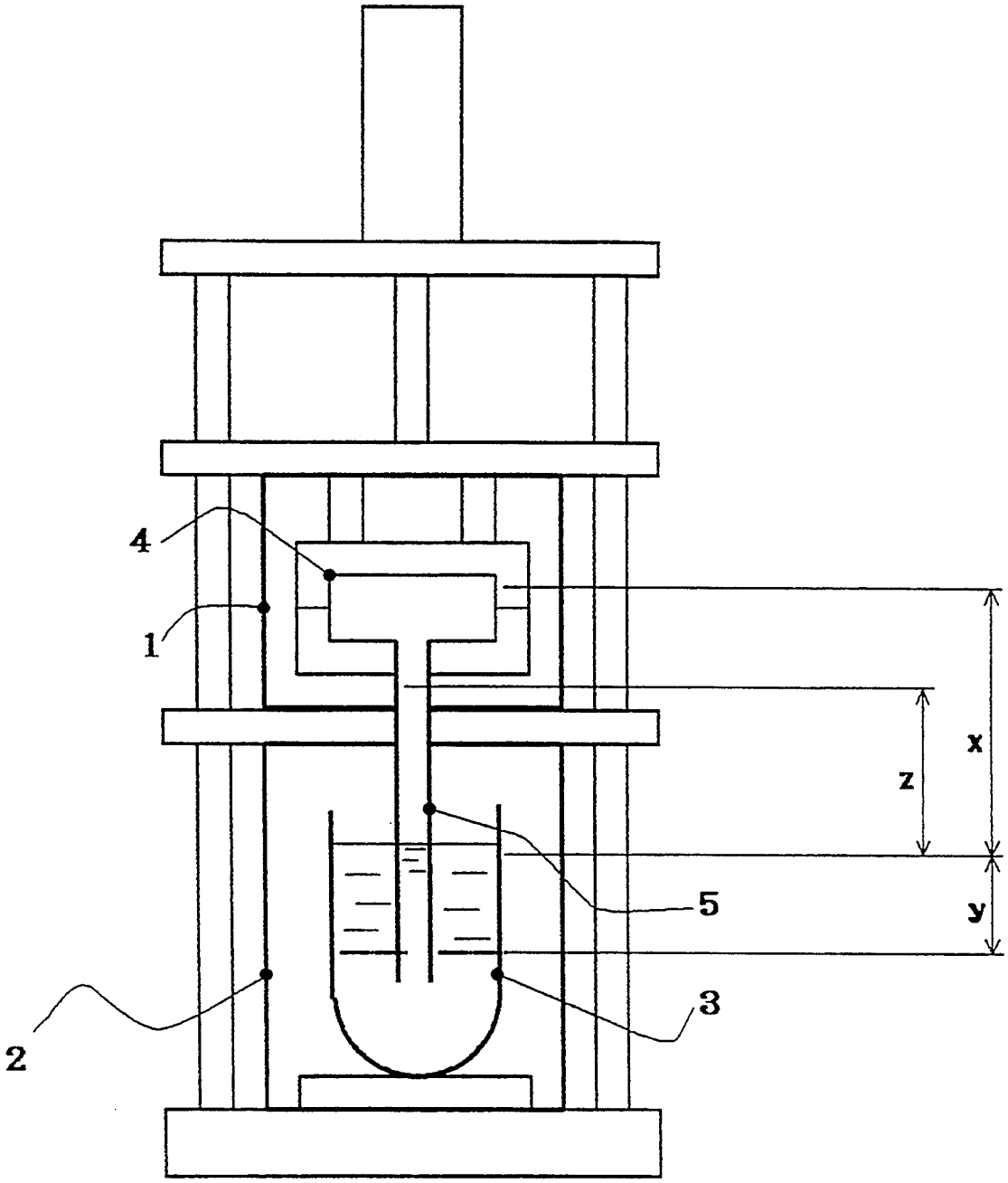
FIG. 19 PRIOR ART
FIG. 19 is an explanatory view showing a conventional counter pressure casting device.

A casting was obtained by following the procedure of EXAMPLE 1 except a use of pressure control pattern of FIG. 18, which shows a conventional counter pressure casting.

The results obtained by evaluating characteristics of the casting are shown in Table 1.

EXAMPLE 2-1

Using the device shown in FIG. 13, an aluminum wheel was cast by pressurizing up to 6 kgf/cm using aluminum alloy molten metal of Al—Si—Mg composition with P1 as 30% (1.8 kgf/cm$^2$) of P5 according to the pressure control pattern shown in FIG. 3.

The results obtained by evaluating characteristics of the casting are shown in Table 1.

EXAMPLE 2-2

Using the device shown in FIG. 13, a corrosion-resistant part was Vast from aluminum alloy molten metal of Al—Mg composition with P1 as 20% of P5 according to the pressure control pattern shown in FIG. 3.

The results obtained by evaluating characteristics of the casting are shown in Table 1.

EXAMPLE 2-3

Using the device shown in FIG. 13, an automobile engine block was cast from aluminum alloy molten metal of Al—Si—Cu composition with P1 as 30% of P4 according to the pressure control pattern shown in FIG. 4. The results obtained by evaluating characteristics of the casting are shown in Table 1.

EXAMPLE 2-4

Using the device shown in FIG. 13, an automobile thick wall part was cast from aluminum alloy molten metal of Al—Cu composition with P1 as 30% of P5 according to the pressure control pattern shown in FIG. 5.

The results obtained by evaluating characteristics of the casting are shown in Table 1.

EXAMPLE 2-5

Using the device shown in FIG. 13, an automobile large-sized tough part was cast from aluminum alloy molten metal of Al—Cu—Mg composition with P1 as 20% of P6 according the pressure control pattern shown in FIG. 6.

The results obtained by evaluating characteristics of the casting are shown in Table 1.

COMPARATIVE EXAMPLE 2-1

A casting was produced by following the procedure of EXAMPLE 2-1 except a use of pressure control pattern of FIG. 18, which shows a conventional counter pressure casting.

The results obtained by evaluating characteristics of the casting are shown in Table 1.

COMPARATIVE EXAMPLE 2-2

A casting was produced by following the procedure of EXAMPLE 2-2 except a use of pressure control pattern of FIG. 18, which shows a conventional counter pressure casting.

The results obtained by evaluating characteristics of the casting are shown in Table 1.

COMPARATIVE EXAMPLE 2-3

A casting was produced by following the procedure of EXAMPLE 2-3 except a use of pressure control pattern of FIG. 18, which shows a conventional counter pressure casting.

The results obtained by evaluating characteristics of the casting are shown in Table 1.

COMPARATIVE EXAMPLE 2-4

A casting was produced by following the procedure of EXAMPLE 2-4 except a use of pressure control pattern of FIG. 18, which shows a conventional counter pressure casting.

The results obtained by evaluating characteristics the casting are shown in Table 1.

COMPARATIVE EXAMPLE 2-5

A casting was produced by following the procedure EXAMPLE 2-5 except a use of pressure control pattern of FIG. 18, which shows a conventional counter pressure casting.

The results obtained by evaluating characteristics of the casting are shown in Table 1.

the casting mold in the molten metal feeding pipe. After T6, the pressures in both containers were reduced discharging the gas in the containers to the atmosphere. The pressure in the holding furnace side container was reduced to keep a pressure of 0.15 kgf/cm$^2$ so that the molten metal free surface is held statically.

Table 2 shows the results of evaluation of the casting.

EXAMPLE 3-2

Using the device shown in FIG. 13, a decorative part which was required to have corrosion resistance was cast from aluminum alloy molten metal of Al—Mg composition with P1 set to 15% of P5 according to the pressure control pattern shown in FIG. 7.

Table 2 shows the results of evaluation of the casting.

EXAMPLE 3-3

Using the device shown in FIG. 13, an automobile engine block was cast from aluminum alloy molten metal of Al—Si—Cu composition with P1 set to 15% of P4 according to the pressure control pattern shown in FIG. 8.

Table 2 shows the results of evaluation of the casting.

TABLE 1

| | Casting Condition | | | | | | | | | Cast Product Characteristics | | | | |
|---|---|---|---|---|---|---|---|---|---|---|---|---|---|---|
| | Molten Metal Composition (wt %) | | | | | | | | Pressurizing | Tensile Strength | Endurance | Elongation | Hardness | |
| | JIS | Si | Fe | Cu | Mn | Mg | Ti | Al | Pattern | (MPa) | (MPa) | (%) | (HB) | Product |
| Example | | | | | | | | | | | | | | |
| 1 | AC4CH | 7.0 | 0.1 | — | — | 0.3 | 0.1 | bal. | 80% | 300 | 230 | 12 | 80 | Alminum wheel |
| 2-1 | AD4CH | 7.0 | 0.1 | — | — | 0.3 | 0.1 | bal. | 30% | 300 | 250 | 15 | 80 | Alminum wheel |
| 2-2 | AC7A | — | 0.1 | — | 0.1 | 5.0 | — | bal. | 20% | 300 | 200 | 20 | 60 | Corrosion resistant part |
| 2-3 | AC4B | 8.0 | 0.3 | 3.0 | 0.2 | 0.2 | 0.1 | bal. | 30% | 300 | 250 | 4 | 90 | Engine block |
| 2-4 | AC1B | — | 0.1 | 4.0 | — | 0.2 | 0.1 | bal. | 30% | 420 | 380 | 10 | 100 | Automobile thick part |
| 2-5 | 2014 | 0.7 | 0.2 | 4.5 | 1.0 | 0.5 | 0.1 | bal. | 20% | 350 | 300 | 15 | 90 | Large size tough part |
| Comparative Ex. | | | | | | | | | | | | | | |
| 1 | AC4CH | 7.0 | 0.1 | — | — | 0.3 | 0.1 | bal. | 100% | 280 | 220 | 10 | 80 | Alminum wheel |
| 2-1 | AD4CH | 7.0 | 0.1 | — | — | 0.3 | 0.1 | bal. | 100% | 280 | 250 | 10 | 80 | Alminum wheel |
| 2-2 | AC7A | — | 0.1 | — | 0.1 | 5.0 | — | bal. | 100% | 270 | 200 | 10 | 50 | Corrosion resistant part |
| 2-3 | AC4B | 8.0 | 0.3 | 3.0 | 0.2 | 0.2 | 0.1 | bal. | 100% | 260 | 250 | 2 | 90 | Engine block |
| 2-4 | AC1B | — | 0.1 | 4.0 | — | 0.2 | 0.1 | bal. | 100% | 380 | 350 | 7 | 100 | Automobile thick part |
| 2-5 | 2014 | 0.7 | 0.2 | 4.5 | 1.0 | 0.5 | 0.1 | bal. | 100% | 300 | 250 | 10 | 90 | Large size tough part |

As shown in Table 1, each product of examples according to this invention shows superior characteristics as compared with each of comparative examples, particularly the inventive samples exhibit superior tensile strength and elongation.

EXAMPLE 3-1

Using the device of FIG. 13, an aluminum wheel was cast by pressurizing up to 6 kgf/cm$^2$ using aluminum alloy molten metal of Al—Si—Mg composition with P1 as 27% of P5 according to the pressure control pattern shown in FIG. 7. The holding furnace side was previously applied a pressure of 0.15 kgf/cm$^2$ so that the molten metal free surface was positioned near the sprue of the casting mold in the molten metal feeding pipe before starting the casting. The holding furnace side pressure was lowered to a pressure 0.15 kgf/cm$^2$ higher than the casting mold side pressure from T5 to T6, thereby the molten metal was returned so that the molten metal free surface was positioned near the sprue of

EXAMPLE 3-4

Using the device shown in FIG. 13, an automobile thick-wall part was cast from aluminum alloy molten metal of Al—Cu composition with P1 set to 17% of P4 according to the pressure control pattern shown in FIG. 9.

Table 2 shows the results of evaluation of the casting.

EXAMPLE 3-5

Using the device shown in FIG. 13, a large tough part was cast from aluminum alloy molten metal of Al—Cu—Mg composition with P1 set to 15% of P6 according to the pressure control pattern shown in FIG. 10. Table 2 shows the results of evaluation of the casting.

COMPARATIVE EXAMPLE 3-1

A casting was produced by following the procedure Example 3-1 except a use of pressure control pattern of FIG. 18, which shows a conventional counter pressure casting. Table 2 shows the results of evaluation of the casting.

COMPARATIVE EXAMPLE 3-2

A casting was produced by following the procedure of Example 3-2 except a use of pressure control pattern of FIG. 18, which shows a conventional counter pressure casting. Table 2 shows the results of evaluation of the casting.

COMPARATIVE EXAMPLE 3-3

A casting was produced by following the procedure of Example 3-3 except a use of pressure control pattern of FIG. 18, which shows a conventional counter pressure casting, Table 2 shows the results of evaluation of the casting.

COMPARATIVE EXAMPLE 3-4

A casting was produced by following the procedure of Example 3-4 except a use of pressure control pattern of FIG. 18, which shows a conventional counter pressure casting. Table 2 shows the results of evaluation of the casting.

COMPARATIVE EXAMPLE 3-5

A casting was produced by following the procedure of Example 3-5 except a use of pressure control pattern of FIG. 18, which shows a conventional counter pressure casting. Table 2 shows the results of evaluation of the casting.

TABLE 2

| | Casting Condition | | | | | | | | | Cast Product Characteristics | | | | |
|---|---|---|---|---|---|---|---|---|---|---|---|---|---|---|
| | Molten Metal Composition (wt %) | | | | | | | | Pressurizing | Tensile Strength | Endurance | Elongation | Hardness | |
| | JIS | Si | Fe | Cu | Mn | Mg | Ti | Al | Pattern | (MPa) | (MPa) | (%) | (HB) | Product |
| Example | | | | | | | | | | | | | | |
| 3-1 | AD4CH | 7.0 | 0.1 | — | — | 0.3 | 0.1 | bal. | 27% | 300 | 250 | 15 | 80 | Alminum wheel |
| 3-2 | AC7A | — | 0.1 | — | 0.1 | 5.0 | — | bal. | 15% | 300 | 200 | 20 | 60 | Corrosion resistant part |
| 3-3 | AC4B | 8.0 | 0.3 | 3.0 | 0.2 | 0.2 | 0.1 | bal. | 15% | 300 | 250 | 4 | 90 | Engine block |
| 3-4 | AC1B | — | 0.1 | 4.0 | — | 0.2 | 0.1 | bal. | 17% | 420 | 380 | 10 | 100 | Automobile thick part |
| 3-5 | 2014 | 0.7 | 0.2 | 4.5 | 1.0 | 0.5 | 0.1 | bal. | 15% | 350 | 300 | 15 | 90 | Large size tough part |
| Comparative Ex. | | | | | | | | | | | | | | |
| 3-1 | AD4CH | 7.0 | 0.1 | — | — | 0.3 | 0.1 | bal. | 100% | 280 | 250 | 10 | 80 | Alminum wheel |
| 3-2 | AC7A | — | 0.1 | — | 0.1 | 5.0 | — | bal. | 100% | 270 | 200 | 10 | 50 | Corrosion resistant part |
| 3-3 | AC4B | 8.0 | 0.3 | 3.0 | 0.2 | 0.2 | 0.1 | bal. | 100% | 260 | 250 | 2 | 90 | Engine block |
| 3-4 | AC1B | — | 0.1 | 4.0 | — | 0.2 | 0.1 | bal. | 100% | 380 | 350 | 7 | 100 | Automobile thick part |
| 3.5 | 2014 | 0.7 | 0.2 | 4.5 | 1.0 | 0.5 | 0.1 | bal. | 100% | 300 | 250 | 10 | 90 | Large size tough part |

As shown in Table 2, each product of examples according to the present invention shows superior characteristics as compared with each of comparative examples, particularly the inventive samples, exhibit superior tensile strength and elongation.

EXAMPLE 4

Figure 14:
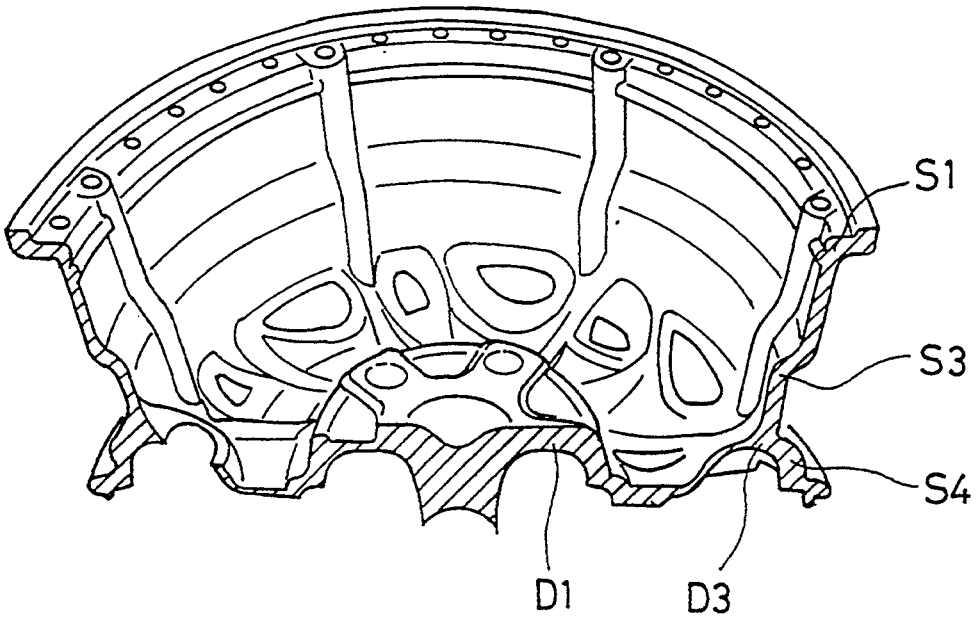
FIG. 14 is a perspective view showing a casting produced by the counter pressure casting of this invention.

By using the counter pressure casting device shown in FIG. 13, the aluminum wheel shown in FIG. 14 was cast by being pressurized up to 6 kgf/cm$^2$ according to the pressure control pattern shown in FIG. 11. Thermocouples 6 were disposed at each position of the casting mold 4 corresponding to the positions S1, S3, S4, D1 and D3 of the product shown in FIG. 14, so that the measured temperatures were inputted in the pressure control device 7. The pressures in the casting mold side container 1 and holding furnace side container 2 were set based on the measured temperature information.

Figure 15:
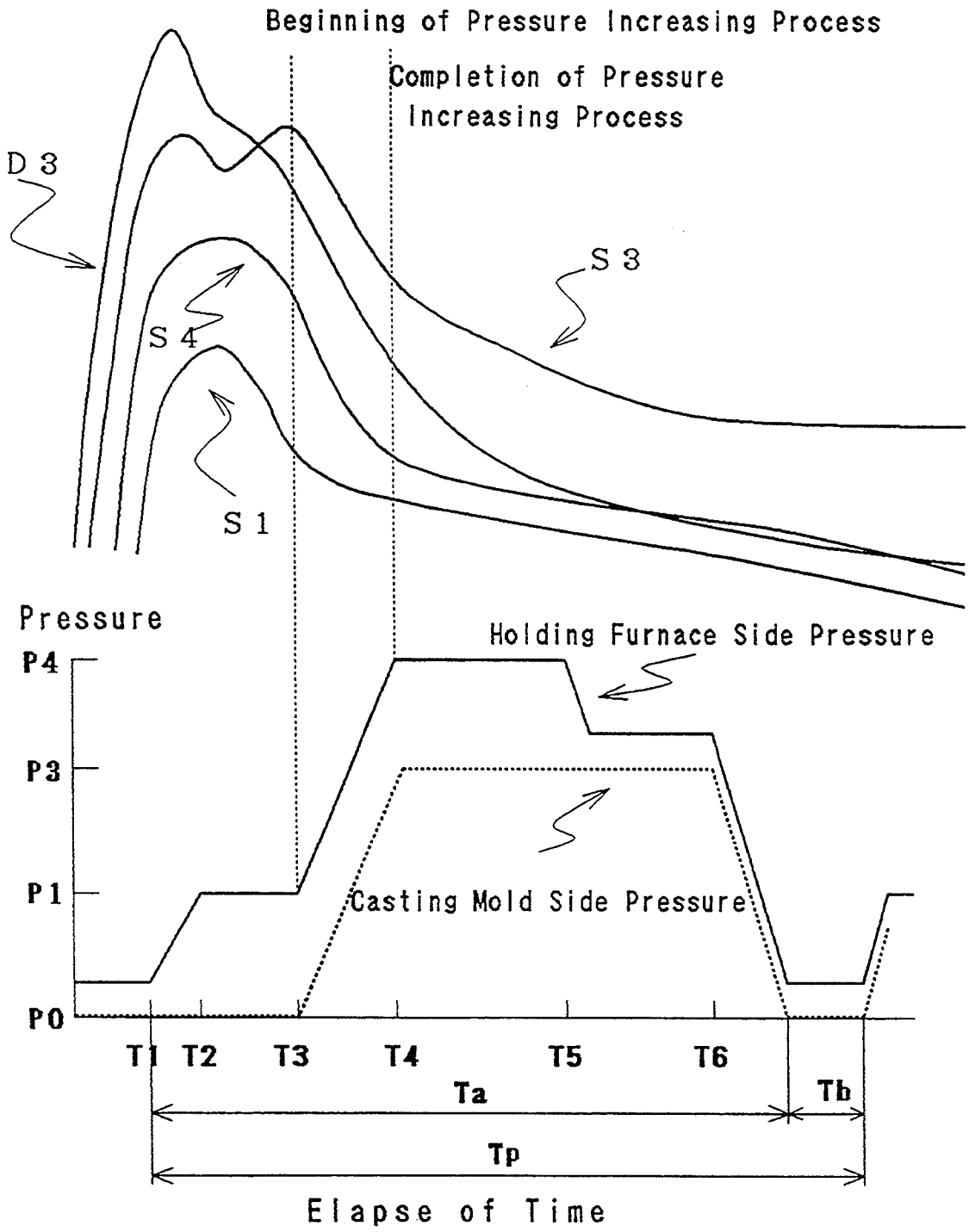
FIG. 15 is a graph showing the pressure control pattern with respect to the holding furnace side container and the casting mold side container according to the present invention in view of the relation with the temperature changes of the molten metal in the casting mold.

More specifically, as shown in FIG. 15, the casting mold side container 1 was kept at the atmospheric pressure, while the holding furnace side container 2 alone was pressurized to P1 (1.5 kgf/cm$^2$) by the pressure means 9, thereby the molten metal was fed into the casting mold 4, then the pressure in the holding furnace side container 2 was kept constant from T2 to T3 after charging of the molten metal into the casting mold was confirmed by the thermocouples 6 mentioned above. Then, till T4 from T3 when the temperature measured by the thermocouple 6 disposed at the position S3 started to decrease, pressures in both containers 1 and 2 were started to be increased simultaneously holding the differential pressure of 1.5 kgf/cm$^2$ between the both containers.

Then, at T4, pressure increase in both containers was stopped simultaneously to maintain the differential pressure of 1.5 kgf/cm$^2$ between both container 1 and 2 for a certain time. Then, after T5, the holding furnace side pressure was lowered to a pressure 0.15 kgf/cm$^2$ higher than the casting mold side pressure so that the molten metal was returned to allow the molten metal free surface to position near the sprue of the casting mold in the molten metal feeding pipe. After T6, the pressures in both containers were reduced discharging tile gas in the containers to the atmosphere. The pressure in the furnace side container was reduced to keep a pressure of 0.15 kgf/cm$^2$ so that the molten metal free surface is held statically.

Figure 16:
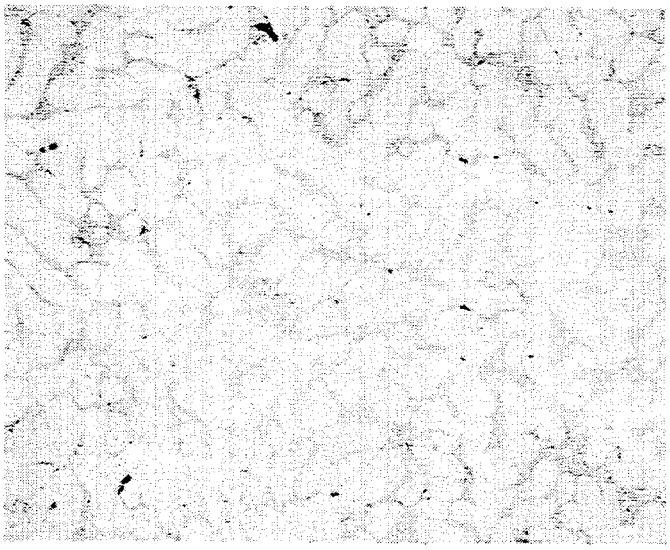
FIG. 16 is a photograph showing a cross sectional microstructure of the casting prepared by the present invention. (magnification 100 times)

FIG. 16 is a photograph showing a cross sectional microstructure of thin wall portion of the product.

COMPARATIVE EXAMPLE 4

Figure 17:
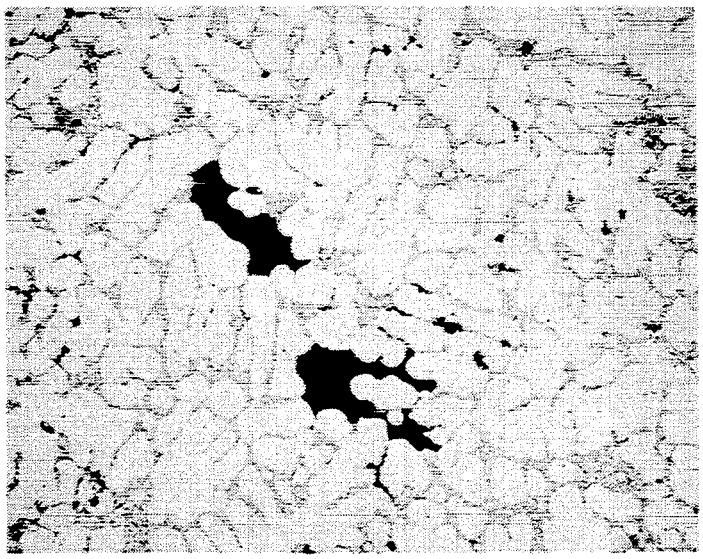
FIG. 17 is a photograph showing a cross sectional microstructure of the casting of the comparative example. (magnification 100 times)

A casting was produced by following the procedure of EXAMPLE 4 except that the pressure control pattern shown in FIG. 3 was used. FIG. 17 is a photograph showing a cross sectional microstructure of the thin wall portion of the product.

As shown in FIG. 17, concentration of casting defects is recognized in the product of the comparative example, while such a concentration of casting defects is not recognized in the product of the example as shown in FIG. 16.

According to the counter pressure casting of EXAMPLE 4 of this invention, after charging the molten metal into the casting mold, the casting mold side container is still set to be retained at a low pressure compared with the holding furnace side pressure before the pressures in the both containers start to be increased simultaneously. This contributes to the prevention of concentration of casting defects to a thin-wall portion whose solidification completes at the early stage of casting.

Further, after solidification of the thin-wall portion, both containers are pressurized forming the differential pressure between both containers, so that a good casting with less casting defects is obtained at the thick wall portion.

As described above, according to the counter pressure casting and counter pressure casting device of this invention, at the start, of the molten metal charging into the casting mold, the pressures in the casting mold side container and the holding furnace side container are controlled to low pressures compared with the maximum pressures by the control means. This results in the following effects:

(1) Shortening of the casting cycle time and improvement of productivity of the counter pressure casting for its industrial application.

(2) A casting with less casting defects or less non-metallic inclusion can be obtained even when producing a thick- or thin-wall casting with a complicated shape or using a material that is difficult to cast.

Further, since the differential pressure increasing speed between the furnace side container and the casting mold side container is made to be variable in the molten metal charging process, the following effects can be obtained:

(3) A casting with less casting defects can be obtained even when producing a thick- or thin-wall casting with a complicated shape or using a material that is difficult to cast.

In addition, a pressure higher than atmospheric pressure is set to be applicable to the holding furnace side container to position the molten metal surface near the sprue of the casting mold in the molten metal feeding pipe by the pressure control means. This affects as follows:

(4) The casting cycle can be greatly shortened because the distance between the molten metal surface and the casting mold is shortened and the productivity can be improved.

(5) The quality of casting is improved and dispersion of quality is eliminated because the casting condition is always uniform.

(6) The molten metal stays near the sprue of the casting mold in the molten metal feeding pipe even after the release of pressures in both containers, so that stirring of the molten metal in the furnace due to the reverse flow of the molten metal is avoided resulting in prevention of inclusion of gas and oxide into the molten metal.

(7) The feeding speed into the casting mold can be made slow, so that the casting defects due to the occurrence of turbulence at feeding can be prevented.

(8) The molten metal separation becomes good when the molten metal is returned into the furnace as the neighborhood of the sprue of the casting mold is always heated by the molten metal.

While the invention has been described in detail and with reference to specific embodiments thereof, it will be apparent to one skilled in the art that various changes and modifications can be made therein without departing from the spirit and scope thereof.

What is claimed is:

1. A method for counter pressure casting molten metal in an apparatus, said apparatus comprising (1) a casting mold side pressure container having therein a casting mold and (2) a holding furnace side pressure container having therein a molten metal-containing furnace, said casting mold and said molten metal-containing furnace being in communication via a molten metal feeding pipe, said method comprising the steps of, setting the pressure in the holding furnace side pressure container at a level higher than the pressure in the casting mold side pressure container, to thereby charge molten metal from the molten metal-containing furnace into the casting mold via the molten metal feeding pipe, wherein the pressures in both containers are lower than the maximum pressures of the respective containers, increasing the pressure in the holding furnace side pressure container and the pressure in the casting mold side pressure container, maintaining a pressure differential at a certain level between the pressure in the holding furnace side pressure container and the pressure in the casting mold side pressure container, dissolving the pressure differential between the pressure in the holding furnace side pressure container and the pressure in the casting mold side pressure container, and reducing the pressure in the holding furnace side pressure container and the pressure in the casting mold side pressure container.

2. The method for counter pressure casting molten metal of claim 1, wherein the casting mold comprises a sprue which connects the casting mold and the molten metal feeding pipe, and wherein the pressure in the holding furnace side pressure container is maintained a level slightly higher than atmospheric pressure, so that the surface of the molten metal in the molten metal feeding pipe is no lower than slightly below the sprue.

3. The method for counter pressure casting molten metal of claim 1, wherein said step of setting the pressure comprises increasing the pressure in the holding furnace side pressure container.

4. The method for counter pressure casting molten metal of claim 1, wherein said step of setting the pressure comprises increasing the pressure in the holding furnace side pressure container while maintaining the pressure in the casting mold side pressure container at atmospheric pressure.

5. The method for counter pressure casting molten metal of claim 1, wherein said step of setting the pressure comprises lowering the pressure in the casting mold side pressure container.

6. The method for counter pressure casting molten metal of claim 1, wherein said step of setting the pressure consists of, (1) generating and initially increasing a pressure differential between the pressure in the holding furnace side pressure container and the pressure in the casting mold side pressure container, and (2) further increasing the pressure differential at a greater rate than the initial increasing.

7. The method for counter pressure casting molten metal of claim 1, wherein the pressure differential between the pressure in the holding furnace side pressure container and the pressure in the casting mold side pressure container in said step of setting the pressure, is varied to form a non-linear curve when described as a pressure-time curve.

8. The method for counter pressure casting molten metal of claim 1, wherein at the beginning of the step of setting the pressure, the pressure in the holding furnace side pressure container and the pressure in the casting mold side pressure container are set at 0 to 50% of the maximum pressure in the respective containers.

9. The method for counter pressure casting molten metal of claim 1, further comprising the step of holding the casting mold side pressure container at atmospheric pressure or a low pressure of 3 $kfg/cm^2$ or less for a period of time between said step of setting the pressure and said step of increasing the pressure.

10. The method for counter pressure casting molten metal of claim 1, further comprising, after said step of setting pressure, the step of holding said holding furnace side pressure container and said casting mold side pressure container at a certain pressure for a certain time, to complete solidification of the casting.

11. The method for counter pressure casting molten metal of claim 1, wherein during said pressure increasing step, said pressure differential between the pressure in the holding furnace side pressure container and the pressure in the casting mold side pressure container is held constant.

12. The method for counter pressure casting molten metal of claim 1, wherein during said pressure increasing step, said pressure differential between the pressure in the holding furnace side pressure container and the pressure in the casting mold side pressure container is increased.

13. The method for counter pressure casting molten metal of claim 1, wherein during said pressure differential maintaining step, said pressure differential between the pressure in the holding furnace side pressure container and the pressure in the casting mold side pressure container is varied.

14. The method for counter pressure casting molten metal of claim 1, wherein during said pressure differential maintaining step, said pressure differential between the pressure in the holding furnace side pressure container and the pressure in the casting mold side pressure container is varied depending on the desired condition of the casting.

15. The method for counter pressure casting molten metal of claim 1, wherein during said pressure differential maintaining step, said pressure differential between the pressure in the holding furnace side pressure container and the pressure in the casting mold side pressure container is from 0.5 to 5 $kgf/cm^2$.

* * * * *